US005476027A

United States Patent [19]

Uchida et al.

[11] Patent Number: 5,476,027

[45] Date of Patent: Dec. 19, 1995

[54] BRAIDER

[75] Inventors: Hiroshi Uchida, Oumihachiman; Masao Hirukawa; Yasuo Hisa, both of Nagaokakyo, all of Japan

[73] Assignee: Murata Kikai Kabushiki Kaisha, Kyoto, Japan

[21] Appl. No.: 210,573

[22] Filed: Mar. 18, 1994

[30] Foreign Application Priority Data

Mar. 23, 1993 [JP] Japan ..... 5-062360
May 18, 1993 [JP] Japan ..... 5-025670 U

[51] Int. Cl.[6] ..... D04C 3/48

[52] U.S. Cl. ..... 87/29; 87/34; 87/50

[58] Field of Search ..... 87/9, 11, 28, 29, 87/33, 34, 50; 57/304

[56] References Cited

U.S. PATENT DOCUMENTS

| | | | |
|---|---|---|---|
| 1,830,196 | 11/1931 | Faure-Roux | 87/29 |
| 2,197,111 | 4/1940 | Muller | 87/50 |
| 3,586,058 | 6/1971 | Ahrens et al. | 87/9 X |
| 4,494,436 | 1/1985 | Kruesi | 87/34 X |
| 4,773,208 | 9/1988 | Wolf | 57/304 X |
| 4,902,297 | 2/1990 | Devanathan | 87/1 X |
| 5,067,525 | 11/1991 | Tsuzuki et al. | 87/33 X |
| 5,203,249 | 4/1993 | Adams et al. | 87/34 |
| 5,361,674 | 11/1994 | Akiyama et al. | 87/9 |

*Primary Examiner*—Joseph H. Hail, III
*Attorney, Agent, or Firm*—Loeb & Loeb

[57] ABSTRACT

A braider having a mandrel support member which is pivotable around a braiding point and linearly movable toward and away from the braiding point. Since control of the position of the mandrel is performed by pivotal motion around the braiding point and linear movement in a direction toward the braiding point, the mandrel can be moved to an arbitrary position without depending upon movement of the mandrel by a great distance in one direction.

8 Claims, 21 Drawing Sheets

BRAIDER

BACKGROUND OF THE INVENTION

1. Field of the Invention

This invention relates to a braider for crossing a plurality of yarns, fiber bundles or like element with each other to braid various braids.

2. Prior Art

Conventionally, various braiders wherein a plurality of yarns, fiber bundles or like elements are crossed with each other on a mandrel having a cross section of a circular, square or some other shape to braid a braid are known.

In conventional braiders, however, since the braiding point on the mandrel is spaced away from the position at which axial lines of bobbins placed on bobbin carriers and an axial line of the mandrel intersect with each other, yarns, fiber bundles or like elements (hereinafter referred to merely as "yarns") unwound from the bobbins are bent by a great amount, and this gives rise to such a problem that yarns cannot be unwound smoothly or that excessive tension is applied to yarns, and makes an obstruction to appropriate braiding. Meanwhile, where the yarns are fibers fragile to bending such as glass fibers, such a trouble that the yarns are cut by such bending occurs.

Meanwhile, since the braiding point of the mandrel is spaced away from the position at which the axial lines of bobbins placed on the bobbin carriers and the axial line of the mandrel intersect with each other, the size of the braider is increased as much, resulting in such a problem as deterioration of the operability of the braider or increase of the installation area.

Further, where the tracks have a cylindrical shape, the range of movement of the mandrel is limited, and consequently, there is such a problem that the types of braids which can be braided are limited.

SUMMARY OF THE INVENTION

It is an object of the present invention to provide an automated braider which is superior in productivity or operability solving such subjects of the conventional braiders as described above.

In order to attain the object described above, according to the present invention, a mandrel is disposed in the inside of tracks of a cylindrical or curved surface configuration along which bobbin carriers are travelled and a mandrel support member which is pivotable around a braiding point and is linearly movable toward and away from the braiding point is disposed.

Further, it is proposed a braider in which a braiding point of the mandrel is a position at which axial lines of bobbins placed on the bobbin carriers and an axial line of the mandrel on which braiding is performed intersect with each other, and a braiding position stabilizing guide is disposed in the proximity of the braiding point of the mandrel.

According to the present invention, since the braiding point on the mandrel is at the position at which the axial lines of the bobbins placed on the bobbin carriers and the axial line of the mandrel on which braiding is performed intersect with each other, the yarns unwound from the bobbins are not bent at all, and accordingly, the yarns can be unwound smoothly, and since no excessive tension is applied to the yarns at all, a braid can be braided appropriately.

Since the braiding point on the mandrel is at the position at which the axial lines of the bobbins placed on the bobbin carriers and the axial line of the mandrel on which braiding is performed intersect with each other, the braider is reduced in size, and consequently, the operability of the braider is enhanced and the installation area of the braider is reduced.

Since the braiding position stabilizing guide member is disposed, rocking motion of the yarns which are rocked by movement in lateral directions of the bobbin carriers which travel in a zigzag pattern along the tracks formed in the upper plate can be restricted and a fluctuation of the braiding point by the movement of the mandrel can be suppressed, and consequently, the yarns used for braiding are not crossed in an irregular condition with each other in the proximity of the braiding point and stabilized braiding can be realized. Accordingly, the shape of a braid thus braided is uniform, and the stabilized braid can be produced.

DETAILED DESCRIPTION OF PREFERRED EMBODIMENTS

In the following, an embodiment of the present invention will be described, but the present invention is not limited to the present embodiment unless the spirit of the present invention is exceeded.

First, description will be given of an outline of an entire construction of a braider of the present invention and various apparatus and various members constituting the braider of the present invention with reference to FIG. 1 which is a front elevational view of the braider of the present invention and FIG. 2 which is a side elevational view of the braider. It is to be noted that, in FIGS. 1, 2 and 3, square portions indicated by broken lines above bobbin carriers C show yarn guide portions c3, which will be hereinafter described, in an abbreviated fashion.

The braider BR is constituted from a braider body Bb and a mandrel apparatus Bm. The braider body Bb is constituted from an upper plate U of a curved face configuration having a predetermined radius R of curvature and disposed in a substantially cylindrical base Fb having a horizontal axial line and having an opening e on one side thereof, bobbin carriers C which travel along tracks formed in the upper plate U, a driving apparatus D for driving the bobbin carriers C to travel along the tracks, a braiding position stabilizing guide member G, a cutting apparatus S, a bobbin support apparatus I for bobbins for a core yarn or for reinforcement and some other elements while the mandrel apparatus Bm is constituted from a base Fm and a mandrel moving apparatus M.

In the following, the various apparatus and the various members mentioned above will be described.

First, description will be given principally of the upper plate U of the braider body Bb and the driving apparatus D for driving the bobbin carriers C to travel along the tracks will be described with reference to FIG. 2 and FIG. 3 which is an enlarged front elevational view of the driving apparatus D for driving the bobbin carriers C to travel along the tracks including the cross section taken along line I—I of FIG. 2.

Figure 2:
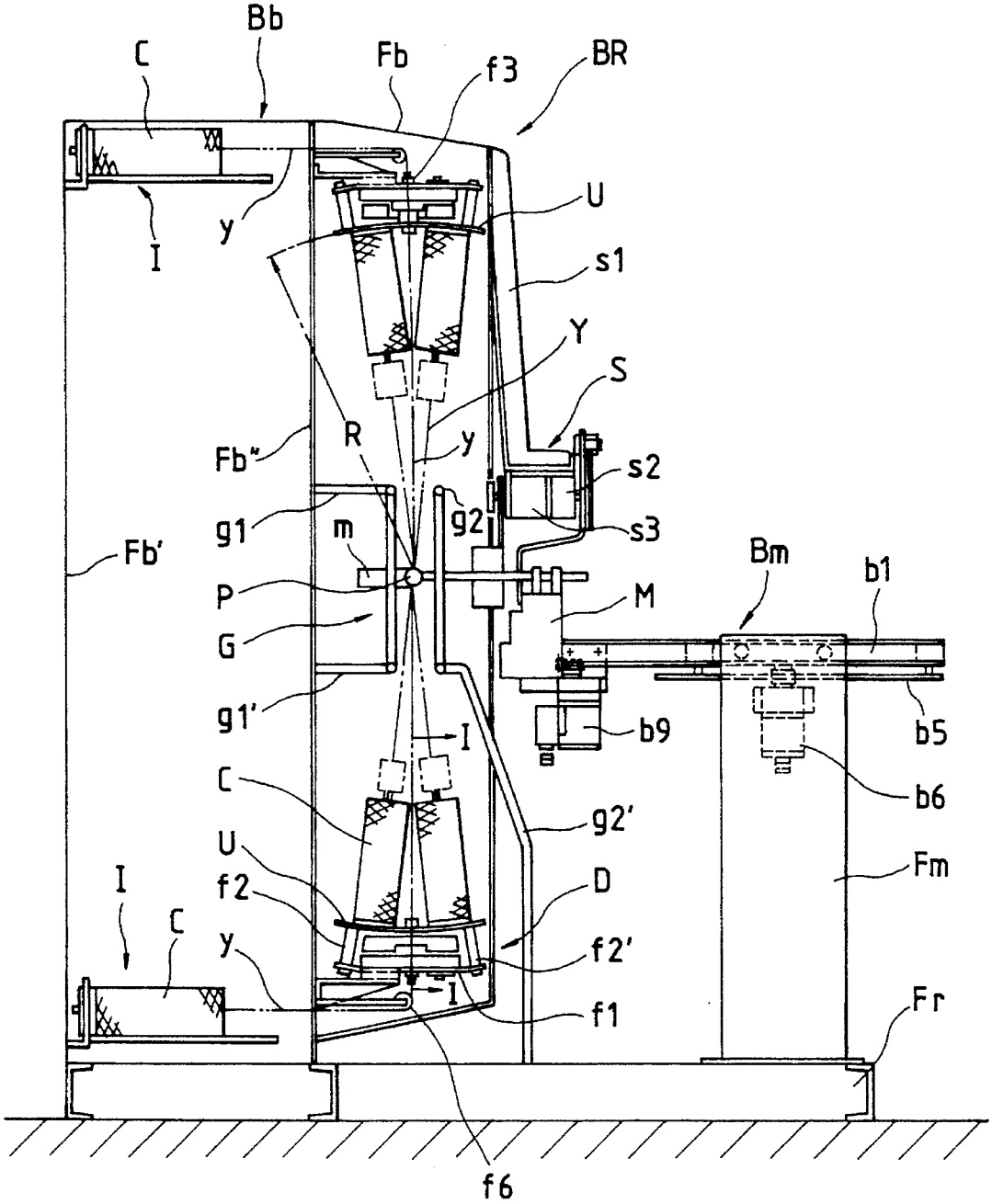
FIG. 2 is a side elevational view of the braider of the present invention.
Figure 3:
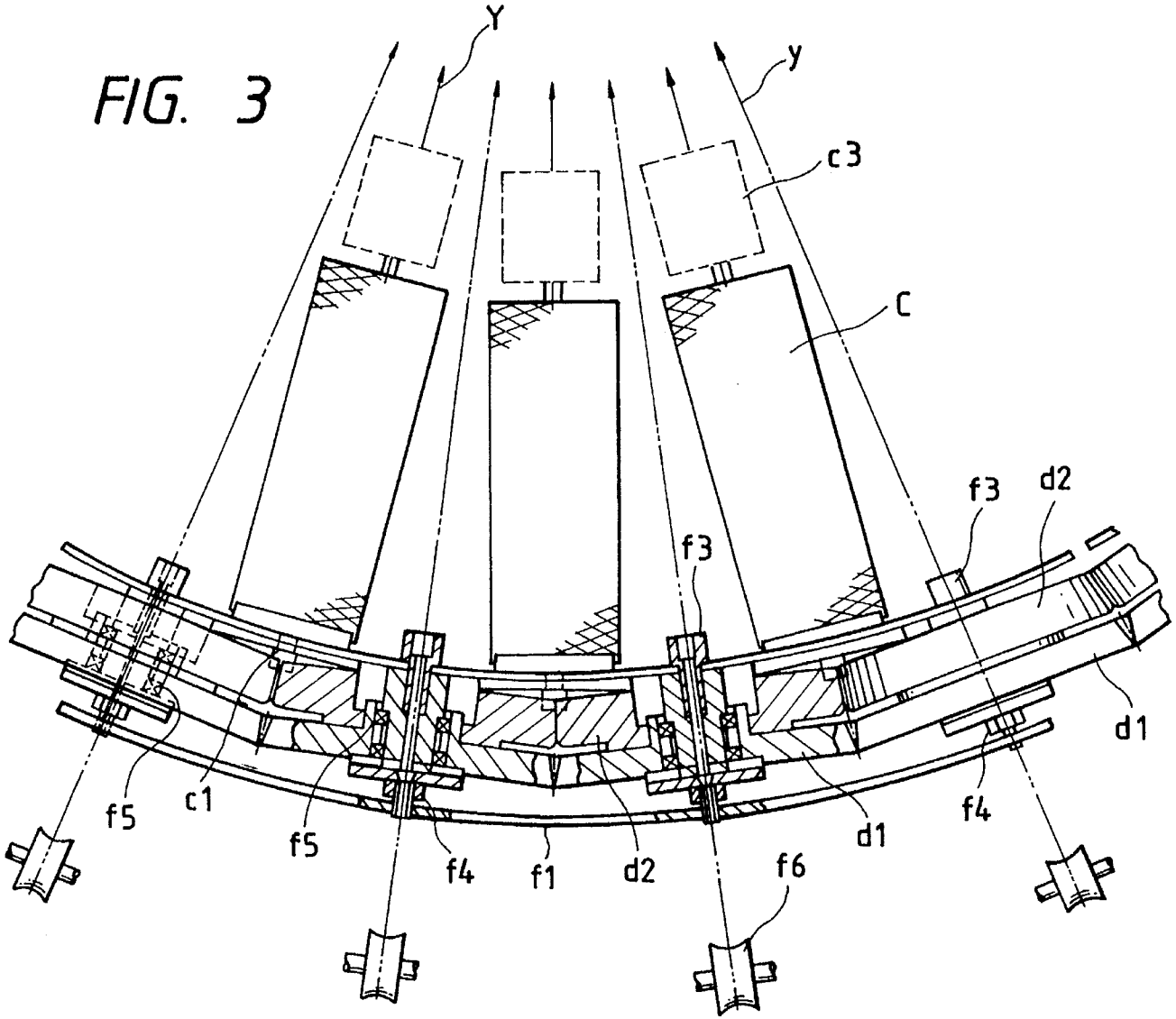
FIG. 3 is an enlarged front elevational view of a driving apparatus for driving bobbin carriers to travel along tracks including a cross section taken along line I—I of FIG. 2.

The upper plate U of a curved face configuration is mounted, as shown in FIG. 2, by suitable fixing members f2, f2' in a predetermined spaced relationship on a substantially cylindrical frame f1 disposed in the substantially cylindrical base Fb, and the known tracks are formed in a circumferential direction in the upper plate U. Reference character f3 denotes a hollow bolt mounted on the frame f1 by means of a nut f4, and a gear d1 is fitted on the hollow bolt f3 by way of a suitable bearing f5. A vane wheel d2 which has, on an upper face thereof, a groove in which an engaging shaft cl of a bobbin carrier C which will be hereinafter described is to be fitted is securely mounted on the gear d1 for integral rotation with the gear d1.

Reference character Y denotes a yarn which is unwound from a bobbin placed on a bobbin carrier C and fed toward a braiding point P on a mandrel m supported on the mandrel apparatus Bm, and reference character y denotes a yarn for a core yarn or for reinforcement (hereinafter referred to merely as "yarn for a core yarn") which is unwound from a bobbin carrier C disposed substantially horizontally on a side wall Fb' of the substantially cylindrical base Fb, guided in a substantially perpendicular direction by a guide roller f6 mounted on the base Fb, inserted into a hollow bolt f3 and then fed toward the braiding point P on the mandrel m.

When the gears d1 are driven to rotate by suitable means such as a motor to rotate the vane wheels d2, the engaging shafts cl of the bobbin carriers C fitted in the groove formed in the vane wheels d2 are moved so that the bobbin carrier C travels along the track. By causing the bobbin carriers C to travel along the tracks formed in the upper plate U of a curved face configuration as described above, a large number of yarns Y are crossed with each other to braid a braid on the mandrel m, and when necessary, the yarns y for a core yarn are supplied from the bobbin carriers C disposed substantially horizontally on the side wall Fb' of the base Fb and are crossed with the yarns Y unwound from the bobbin carriers C travelling along the tracks and used for braiding to braid a braid.

Figure 4:
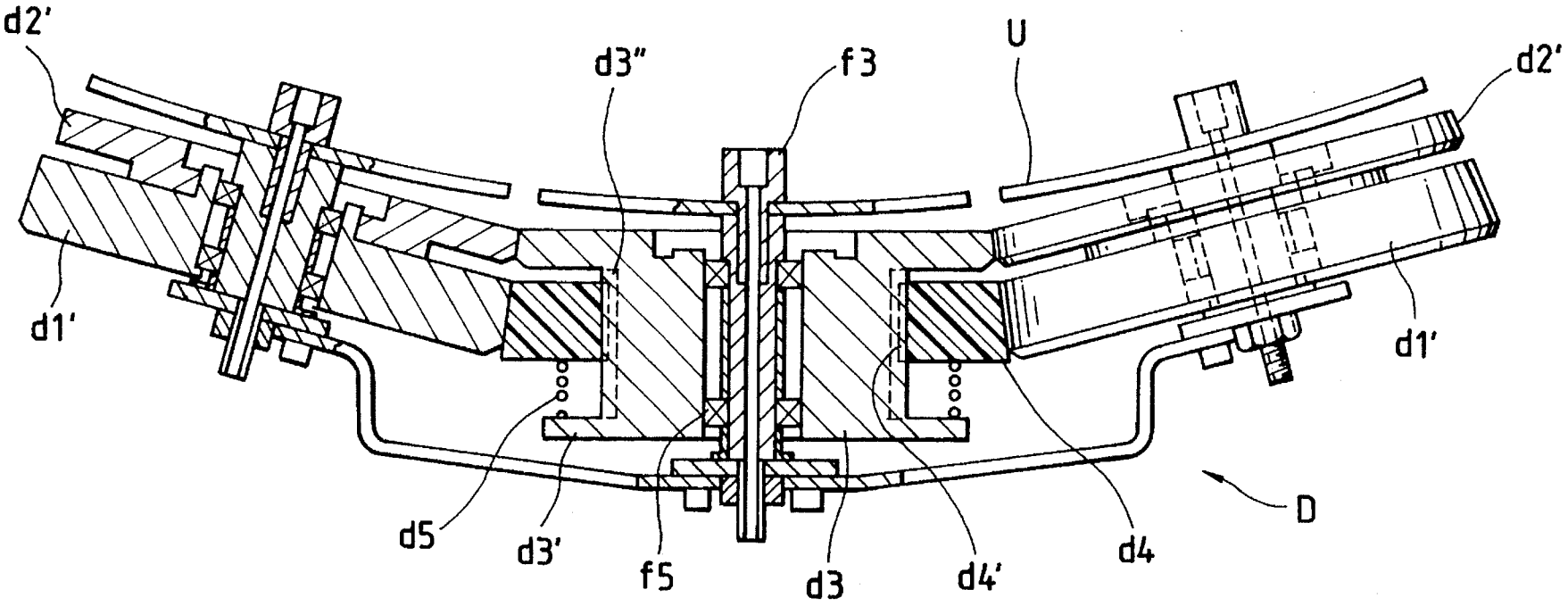
FIG. 4 shows another embodiment of a driving apparatus for driving bobbin carriers to travel along tracks.

FIG. 4 is an enlarged front elevational view of the driving apparatus D showing another embodiment of the driving apparatus D for driving the bobbin carriers C to travel along the tracks, and reference character d1' denotes a friction roller in the form of a disk having no teeth formed thereon as different from the gears d1 described above. The friction roller d1' is fitted on a hollow bolt f3 by way of a bearing f5 similarly to the gears d1 described above. Meanwhile, a vane wheel d2' is fixedly mounted on the friction roller d1' similarly to the gear d1 described above.

Reference character d3 denotes a vane wheel fitted on a hollow bolt f3 by means of a bearing f5 and having a flange portion d3' at a lower end portion thereof, and a suitable number of keyways d3" are formed along the direction of an axial line of the vane wheel d3 on an outer circumferential face of the vane wheel d3. Reference character d4 denotes a sliding friction roller in the form of a disk fitted on the vane wheel d3, and convex rib portions d4' for fitting in the keyways d3" formed on the vane wheel d3 are provided projectingly on the sliding friction roller d4 so that the sliding friction roller d4 is slidingly movable in the direction of the axial line of the vane wheel d3 relative to the vane wheel d3. Meanwhile, a compression spring d5 is disposed between a lower face of the sliding friction roller d4 and the flange portion d3' of the vane wheel d3 and biases the sliding friction roller d4 upwardly.

As shown in FIG. 4, the friction rollers d1' and the sliding friction rollers d4 are disposed alternately, and preferably the friction rollers d1' are formed from iron or a hard synthetic resin while the sliding friction rollers d4 are formed from urethane rubber or a like material which has a high coefficient of friction.

By driving the friction rollers d1' to rotate by suitable driving means such as a motor, the sliding friction rollers d4 which are held in frictional contact with the friction rollers d1' are driven. Meanwhile, since the sliding friction rollers d4 are biased upwardly by the compression springs d5, they are normally held in contact under a suitable pressure with the friction rollers d1', and consequently, transmission of the driving force is performed with certainty.

Due to the construction wherein the bobbin carriers C are driven to travel by the friction rollers d1' and the sliding friction rollers d4 in this manner, production of noise arising from blacklashes of teeth of the gears d1 described above can be prevented.

Figure 1:
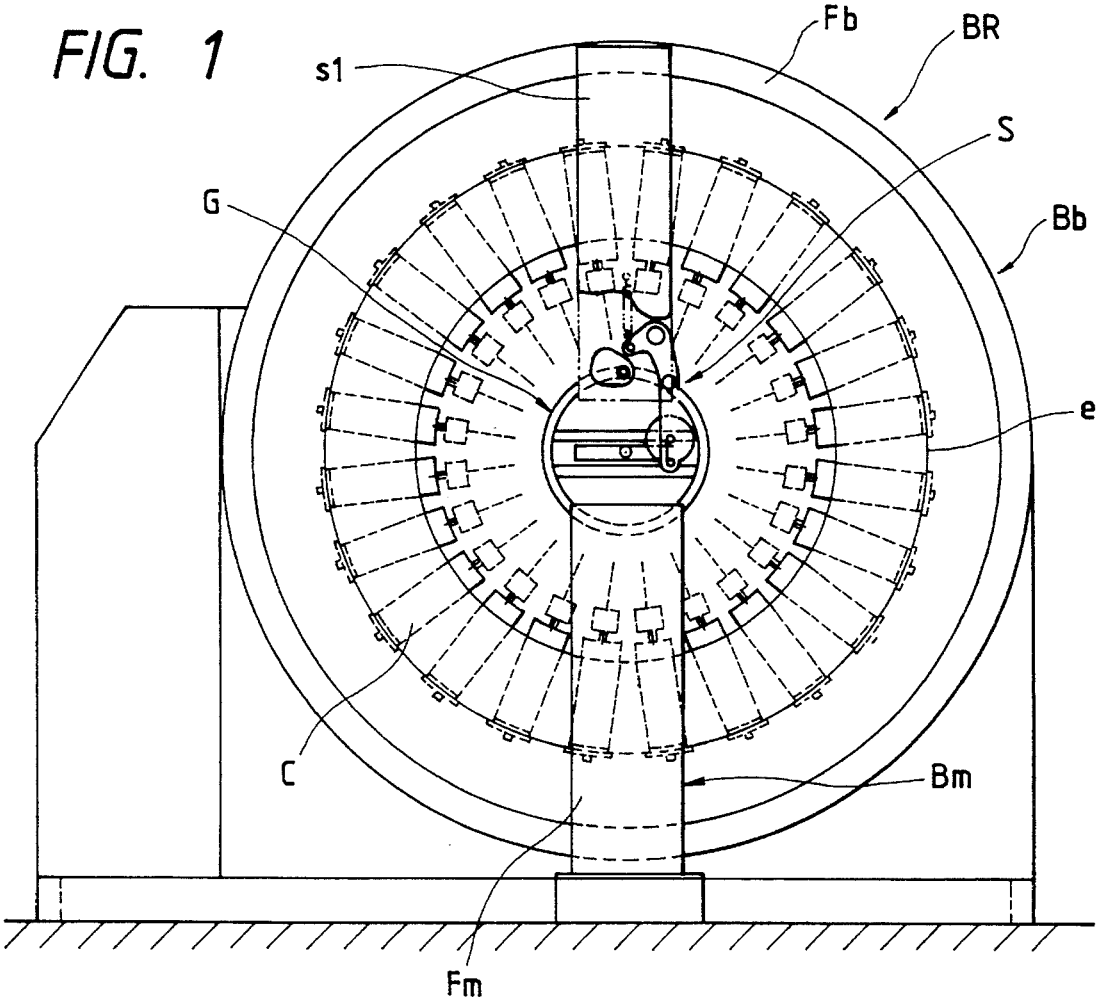
FIG. 1 is a front elevational view of a braider of the present invention.

As shown in FIGS. 1 and 2, the bobbin carriers C are disposed along the tracks formed on a circumferential face of the upper plate U of a curved face configuration, and the yarns Y drawn out from the bobbins placed on the bobbin carriers C in the directions of the axial lines of the bobbins are gathered at the center of the upper plate U of a curved face configuration. The position of the mandrel m is controlled so that the braiding point P of a braid to be braided on the mandrel m mounted on the mandrel apparatus Bm which will be hereinafter described may be positioned at the center of the upper plate U of a curved face configuration.

Subsequently, a bobbin carrier C will be described with reference to FIG. 5 which is a front elevational view of the bobbin carrier C, FIG. 6 which is a front elevational view of a bobbin holding portion, FIG. 7 which is a sectional view taken along line II—II of FIG. 6 and FIG. 8 which is a perspective view of a pivoting portion of a yarn guide portion.

Figure 5:
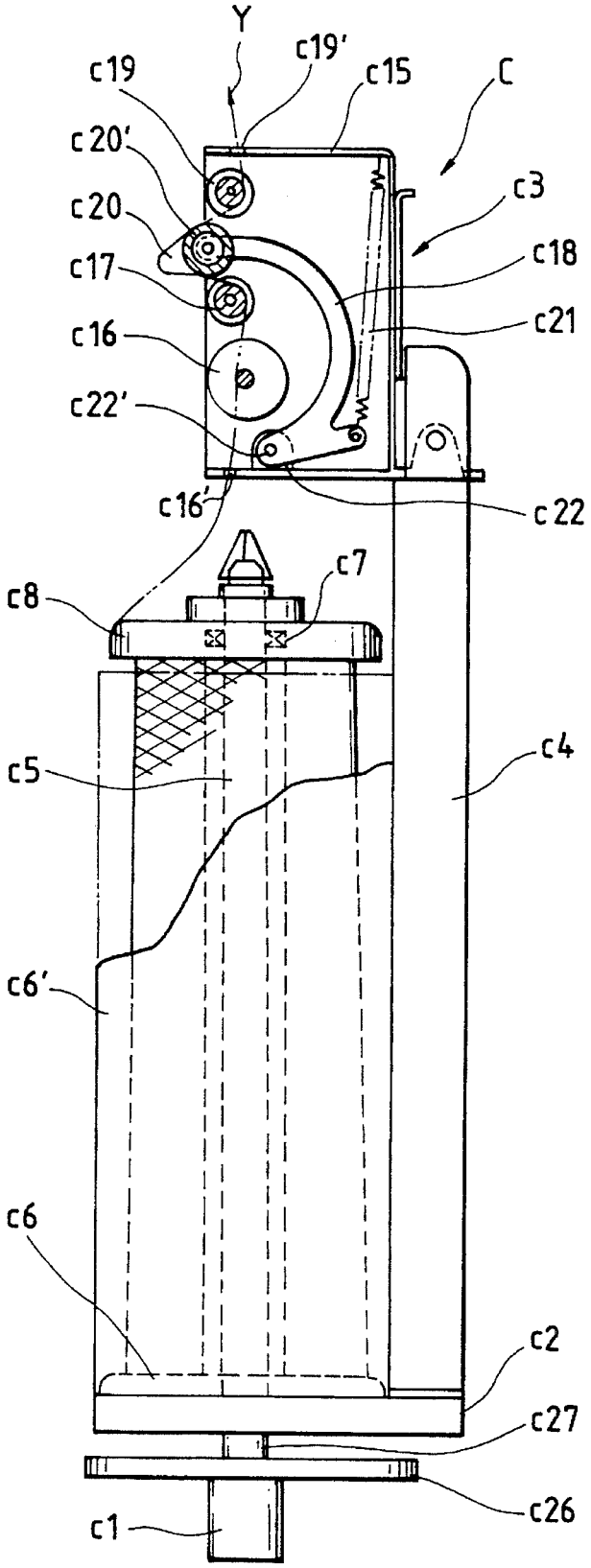
FIG. 5 is a front elevational view of a bobbin carrier.

Referring to FIG. 5, reference character c2 denotes an upper flange, and a mast c4 having a yarn guide portion c3 disposed for pivotal motion at an end portion thereof and having a channel-shaped cross section and a spindle c5 are provided uprightly on the upper flange c2. A bobbin c6 having a yarn Y wound thereon is fitted on the spindle c5, and a flyer c8 having a bearing c7 is fitted for rotation at an end portion of the spindle c5.

Figure 6:
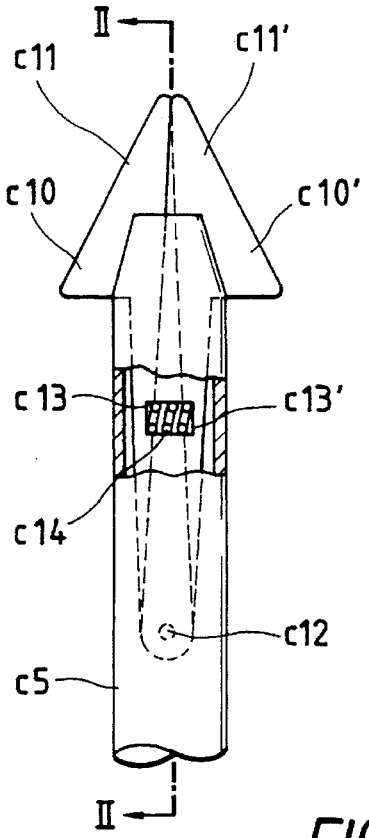
FIG. 6 is a front elevational view of a bobbin holding portion.
Figure 7:
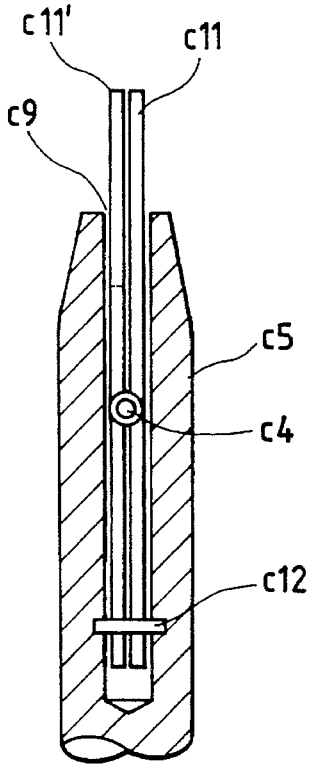
FIG. 7 is a sectional view taken along line II—II of FIG. 6.

As shown in FIGS. 6 and 7, a longitudinally extending slit c9 is formed at an end portion of the spindle c5, and a set of hook members c11, c11' having substantially triangular swollen portions c10, c10' at ends thereof are disposed in the slit c9. The hook members c11, c11' are supported at lower end portions thereof for pivotal motion on a shaft c12 mounted on the spindle c5. Opposing recesses c13, c13' are provided in the proximity of a substantially middle portion between the hook members c11, c11'. And, a compression spring c14 is fitted in the recesses c13, c13' of the hook members c11, c11', and accordingly, the hook members c11, c11' are normally biased in the directions in which they are spaced away from each other. It is to be noted that the hook members c11, c11' are prevented from being spaced away from each other by more than a predetermined distance by means of suitable stoppers not shown. Accordingly, if a bobbin c6 or a flyer c8 is fitted onto the swollen portions c10, c10' of the hook members c11, c11', the hook members c11, c11' are pivoted in the directions in which they move toward each other so that the bobbin c6 or the flyer c8 can be mounted onto the spindle c5. After the bobbin c6 or the flyer c8 is mounted onto the spindle c5, the swollen portions c10, c10' of the hook members c11, c11' are expanded in the directions in which they are spaced away from each other by the compression spring c14 so that the bobbin c6 or the flyer c8 may not come off from the spindle c5.

Reference character c6' denotes a cylindrical bobbin cover, which is mounted on the upper flange c2. The cylindrical bobbin cover c6' prevents such a trouble that, when the bobbin carrier C is inclined or positioned inversely, the yarn Y wound on the bobbin c6 is drawn out or suspended and becomes entangled with the yarn wound around an adjacent bobbin or entangled with some other member of the braider.

A tension washer c16, a guide roller c17, adjusting member c18 and a guide roller c19 are disposed in this order from below on a substantially horizontally laid μ-shaped frame c15 of the yarn guide portion c3 disposed at the end portion of the mast c4. A guide portion c20 having a guide roller c20' thereon is mounted at an end portion of the adjusting member c18 while an end of a coil spring c21 is mounted at the other end of the adjusting member c18, and the other end of the coil spring c21 is mounted on the frame c15. And, the adjusting member c18 is supported for pivotal motion on the frame c15 by way of a shaft member c22' mounted on a bearing member c12 disposed on the frame c15, and is normally biased to pivot in the counterclockwise direction in FIG. 5 by the coil spring c21. Accordingly, when the yarn Y unwound from the bobbin c6 becomes slackened, the adjusting member c18 is pivoted in the counterclockwise direction around the shaft member c22' in FIG. 5 to dissolve the slack of the yarn Y. It is to be noted that perforations c16' and c19' through which the yarn Y is threaded are perforated in the frame c15 adjacent the tension washer c16 and the guide roller c19.

Figure 8:
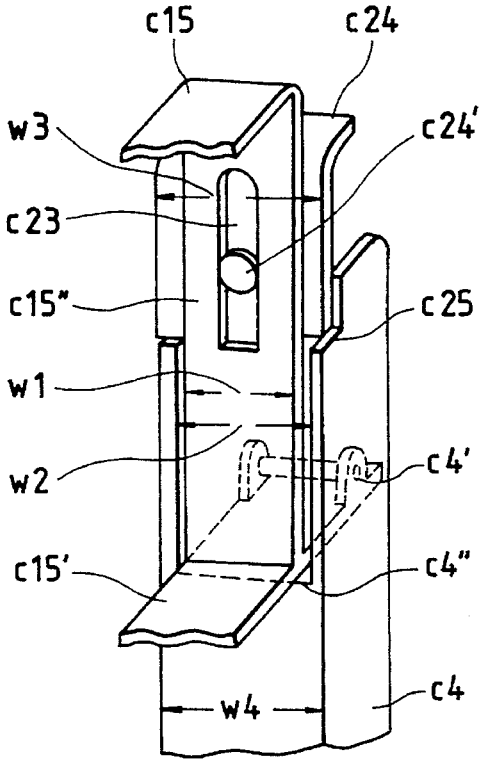
FIG. 8 is a perspective view of a pivoting portion of a yarn guide portion.

As shown in FIG. 8, a lower horizontal portion c15' of the horizontally laid substantially μ-shaped frame c15 extends through a cutaway portion of an end portion of the mast c4, and the lower horizontal portion c15' of the frame c15 is supported at an end portion thereof for pivotal motion on a shaft member c4' disposed at the end portion of the mast c4. A portion in the proximity of an end portion of the lower horizontal portion c15' of the frame c15 is placed on a lower end edge c4" of the cutaway portion of the end portion of the mast c4 so that the lower horizontal portion c15' of the frame c15 may maintain its horizontal condition. Meanwhile, the width w1 of a vertical portion c15" of the frame c15 is set smaller than the width w2 of the cutaway portion of the end portion of the mast c4. And, a vertically elongated perforation c23 is perforated in the vertical portion c15" of the frame c15, and a guide knob c24' of a slider c24 disposed behind the vertical portion c15" of the frame c15 is fitted in the perforation c23. The width w3 of the slider c24 is set substantially equal to the width w4 of the mast c4, and the slider c24 is normally placed on a recessed stepped portion c25 at an end portion of the mast c4.

Accordingly, when the slider c24 is placed on the recessed stepped portion c25 of the end portion of the mast c4, since the slider 24 having the same width w3 as the width w4 of the mast c4 acts as a kind of stopper, the frame c15 will not be pivoted in the clockwise direction in FIG. 5. Meanwhile, when the slider c24 is moved upwardly along the perforation c23 perforated in the vertical portion c15" of the frame c15 until the lower end portion of the slider c24 is disengaged from the end portion of the mast c4, the frame c15 can be pivoted in the clockwise direction in FIG. 5.

Since the construction is such as described above, when it is tried to mount a bobbin c6 or a flyer c8 onto the spindle c5, the slider c24 is moved upwardly and the frame c15 is pivoted in the clockwise direction in FIG. 5 to form a space above the spindle c5, and then the bobbin c6 or the flyer c8 is mounted onto the spindle c5. After the bobbin c6 or the flyer c8 is mounted onto the spindle c5, the frame c15 is pivoted in the counterclockwise direction in FIG. 5 and then the slider c25 is placed onto the recessed stepped portion c25 of the end portion of the mast c4 to hold the frame c15 on the end portion of themast c4 so as not to be pivoted. It is to be noted that, though not shown, preferably the slider c24 is biased in a downward direction by suitable means such as a spring.

Since the space above the spindle c5 can be made completely free before the bobbin c6 is mounted onto the spindle c5 as described above, the bobbin c6 of a large size on which a yarn Y is wound by a large amount can be placed onto the bobbin carrier C, and comparing with conventional arrangements, the number of times for replacement of the bobbin c6 is reduced and the productivity of the braider BR can be enhanced.

It is to be noted that reference character c26 in FIG. 5 denotes a lower flange of a substantially elliptic shape, and c27 denotes a guide portion fitted in and slidably moved along the track formed in the upper plate U and disposed between the upper flange c2 and the lower flange c26. The bobbin carrier C travels along the track while held substantially perpendicularly with respect to the upper plate U with the upper plate U held between the upper flange c2 and the lower flange c26.

Figure 9:
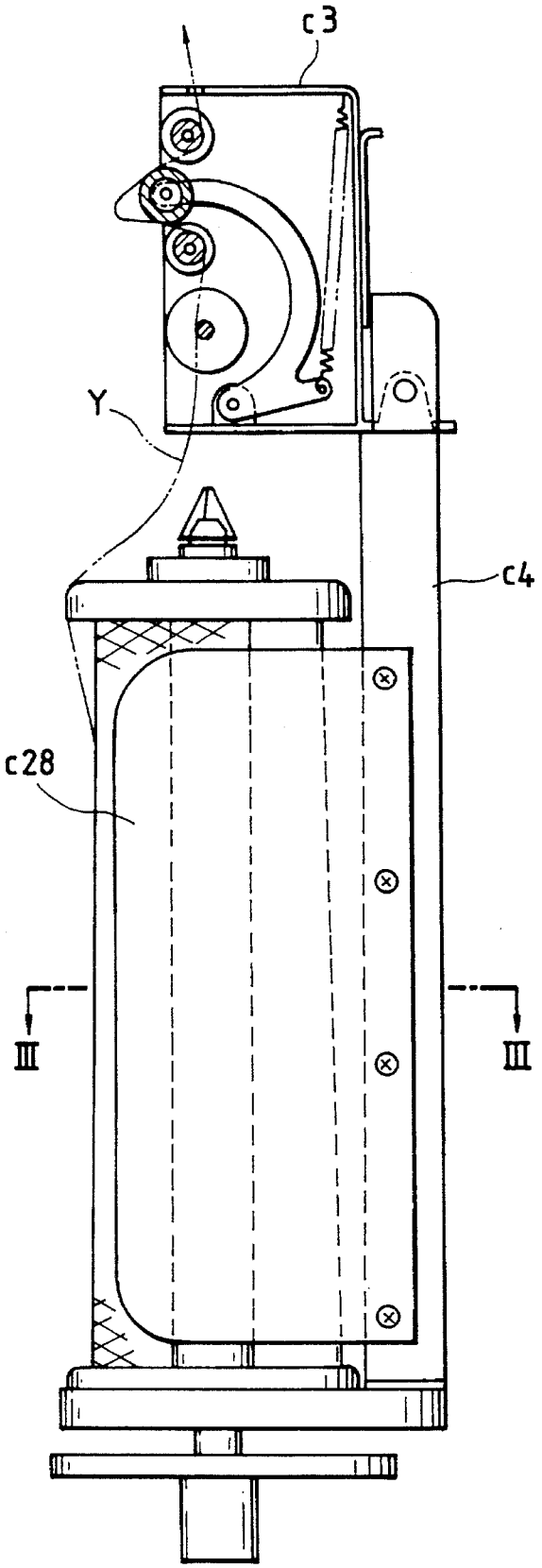
FIG. 9 is a front elevational view showing another embodiment of a bobbin carrier.
Figure 10:
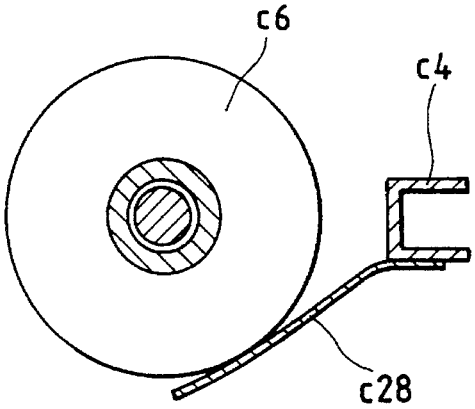
FIG. 10 is a sectional view taken along line III—III of FIG. 9.

FIG. 9 which is a front elevational view of a bobbin carrier C and FIG. 10 which is a sectional view taken along III—III of FIG. 9 show another embodiment of the bobbin carrier C, and the bobbin carrier C shown in FIG. 9 has the same construction as the bobbin carrier C described hereinabove except that, in place of the cylindrical bobbin cover c6' of the bobbin carrier C described hereinabove, a resilient plate c28 formed from a synthetic resin or a like material for contacting with the surface of a yarn Y wound on a bobbin c6 is mounted on the mast c4. Since the resilient plate c28 is normally held in contact with the surface of the yarn Y wound on the bobbin c6, it prevents, similarly to the cylindrical bobbin cover c6' described hereinabove, such a trouble that, when the bobbin carrier C is inclined or positioned inversely, the yarn Y wound on the bobbin c6 is drawn out or suspended and becomes entangled with the yarn wound on an adjacent bobbin or entangled with some other member of the braider.

Figure 11:
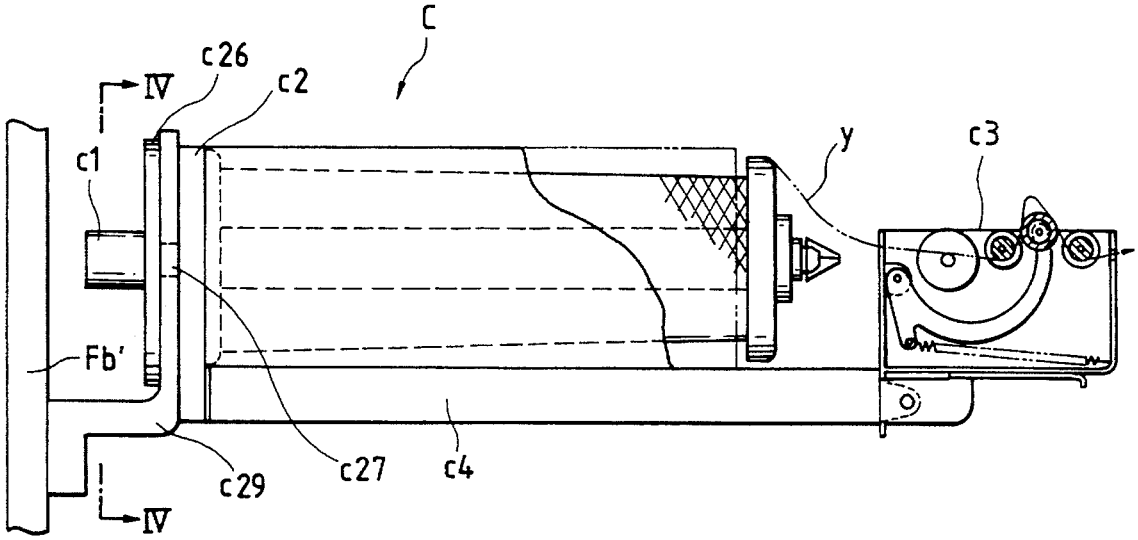
FIG. 11 is a front elevational view of a bobbin support apparatus for a bobbin for a core yarn or for reinforcement.
Figure 12:
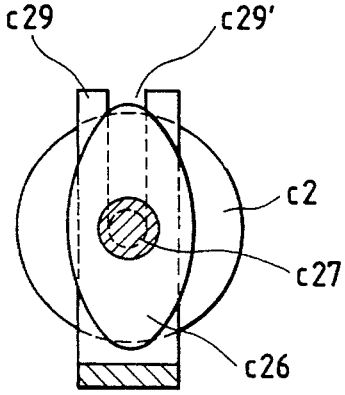
FIG. 12 is a sectional view taken along line IV—IV of FIG. 11.

Subsequently, the bobbin support apparatus I for a bobbin for a core yarn or for reinforcement will be described with reference to FIG. 11 which is a front elevational view of the bobbin support apparatus I for a bobbin for a core yarn or for reinforcement and FIG. 12 which is a sectional view taken along line IV—IV of FIG. 11.

A bobbin carrier holding member c29 in which a vertically elongated groove c29' which has a width substantially equal to the diameter of the guide portion c27 so that the guide portion c27 of a bobbin carrier C can be inserted into the vertically elongated groove c29' is formed is securely mounted on the side wall Fb' of the base Fb. Accordingly, by inserting the guide portion c27 of a bobbin carrier C into the vertically elongated groove c29' of the bobbin carrier holding member c29 and holding the bobbin carrier holding member c29 between the upper flange c2 and the lower flange c26, the bobbin carrier C can be held substantially in a horizontal condition as shown in FIG. 11.

Subsequently, the braiding position stabilizing guide member G will be described with reference to FIG. 2 and FIG. 13 which is a front elevational view of the braiding position stabilizing guide member G.

The braiding position stabilizing guide member G is constituted from a first braiding position stabilizing guide member g1 mounted on a frame g1' extending substantially in a horizontal direction from an intermediate side wall Fb" of the base Fb, and a second braiding position stabilizing guide member g2 mounted at an end portion of another frame g2' provided uprightly on a floor member Fr disposed in a predetermined spaced relationship from the first braiding position stabilizing guide member g1.

The first braiding position stabilizing guide member g1 and the second braiding position stabilizing guide member g2 disposed in the predetermined spaced relationship from each other guide the yarns Y which are rocked by movement in lateral directions of the bobbin carriers C which travel in a zigzag fashion along the track formed in the upper plate U to restrict such rocking motion to keep the braiding point substantially at a fixed position, and by keeping the braiding point substantially at a fixed point in this manner, the yarns Y used for braiding are not crossed in an irregular condition in the proximity of the braiding point and stabilized braiding can be realized. Accordingly, the shape of the braid thus braided is uniform and the stabilized braid can be manufactured.

Meanwhile, since the braiding position stabilizing guide member G is disposed, when it is tried to move the mandrel m in the rightward direction in FIG. 2 after braiding comes to an end, a large number of yarns Y connecting to the braid braided can be gathered by the second braiding position stabilizing guide member g2 so that cutting of the yarns Y by the cutting apparatus S which will be hereinafter described can be performed effectively.

While various members are available as the braiding position stabilizing guide member G which achieves such a function as described above, an example of the braiding position stabilizing guide member G will be described with reference to FIG. 13. It is to be noted that, since the first braiding position stabilizing guide member g1 and the second braiding position stabilizing guide member g2 are formed in a same configuration, description will be given only of the configuration of the first braiding position stabilizing guide member g1 with reference to FIG. 13.

Figure 13A:
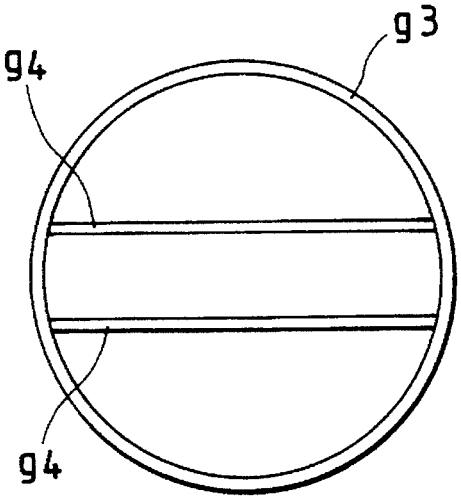
FIGS. 13A and 13C are front elevational views of a braiding position stabilizing guide member.
Figure 13B:
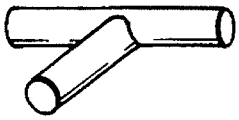
FIGS. 13B and 13D are perspective views of a mandrel.

The braiding position stabilizing guide member G shown in FIG. 13A is constituted from a circular guide member g3 and a horizontal member g4 extending substantially in a horizontal direction and disposed in a predetermined spaced relationship from the circular guide member g3 and is adapted to a case wherein a braid is braided on such a T-shaped mandrel m as shown in FIG. 13B or a like case.

Figure 13C:
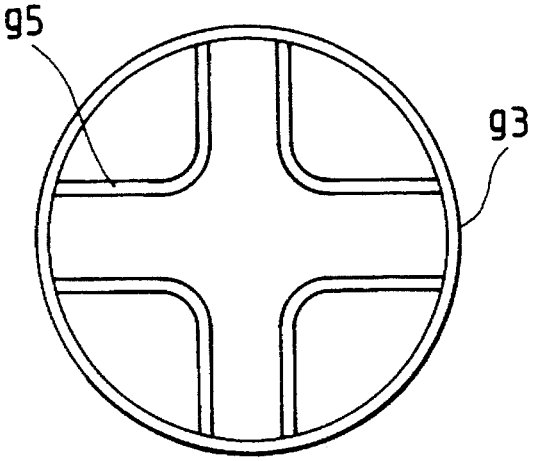
Figure 13D:
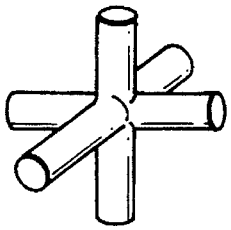

Meanwhile, the braiding position stabilizing guide member G shown in FIG. 13C is constructed such that a cross-shaped guide portion is formed by four L-shaped guide members g5 disposed in the inside of a circular guide member g3, and is adapted to a case wherein a braid is braided on such a mandrel m formed by crossing such cross-shaped members as shown in FIG. 13D with each other or a like case.

Figure 14:
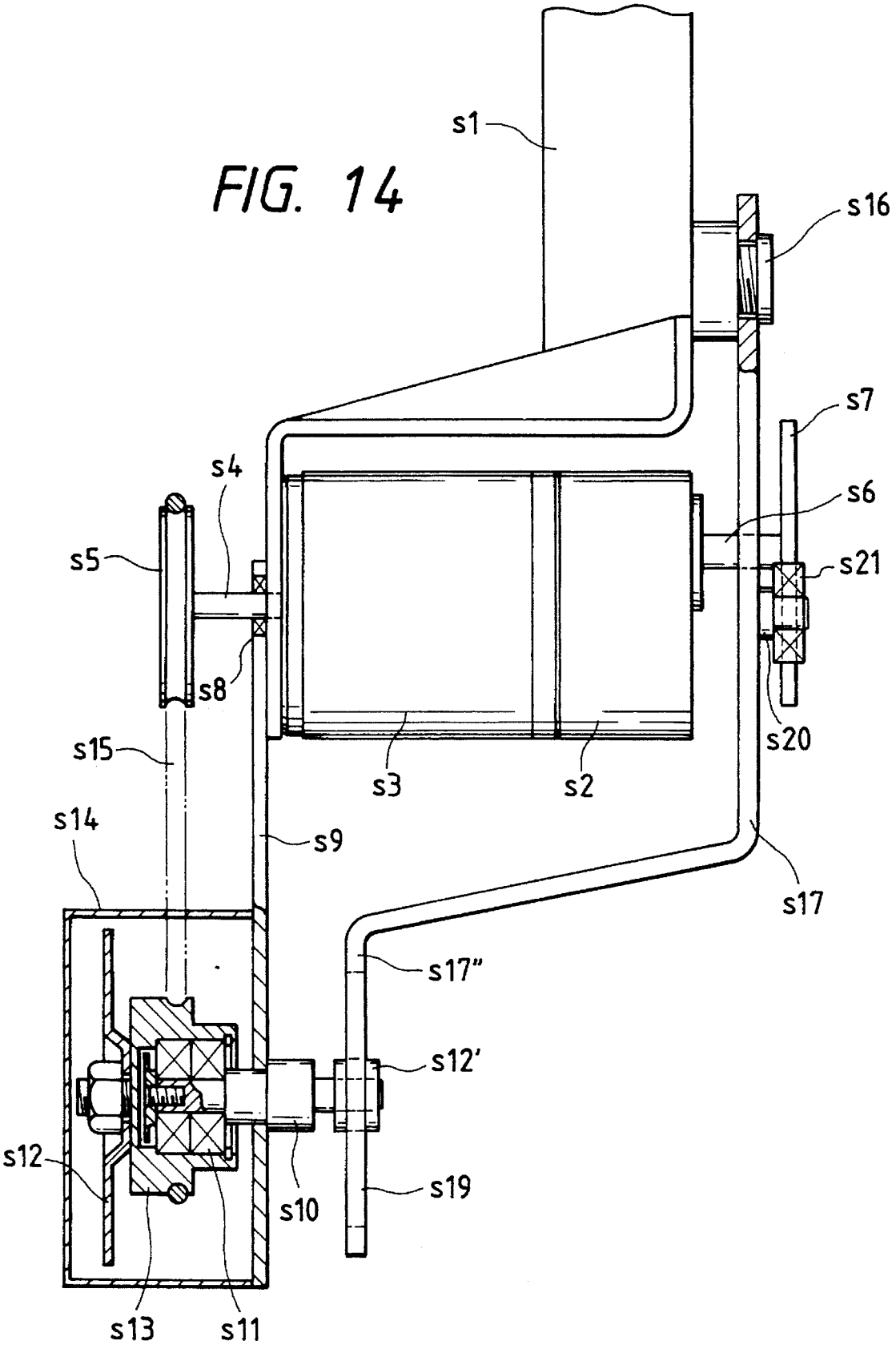
FIG. 14 is a side elevational view including a partial cross section of a cutting apparatus.
Figure 15:
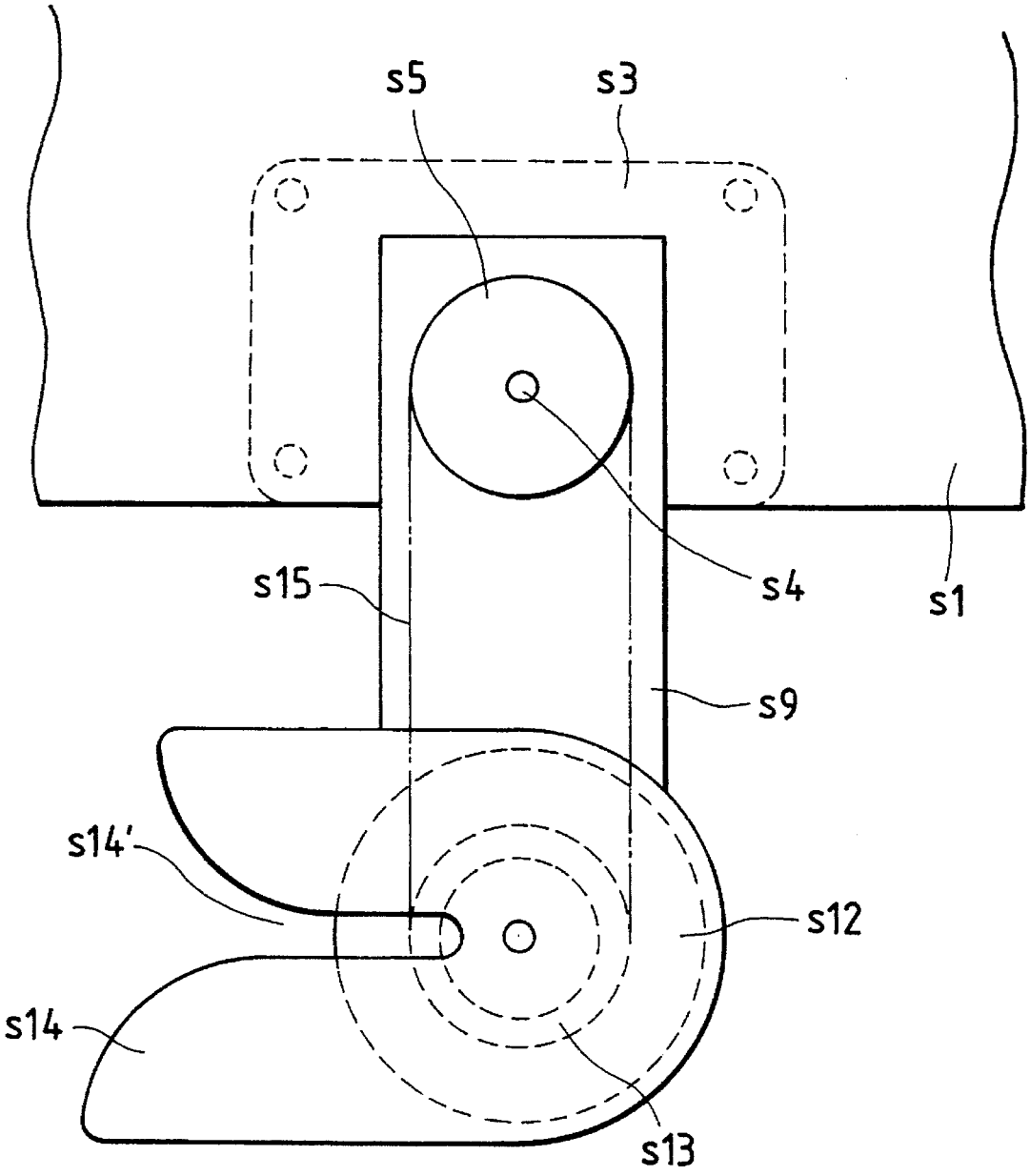
FIG. 15 is a partial enlarged front elevational view of the cutting apparatus.

Subsequently, the cutting apparatus S will be described principally with reference to FIG. 14 which is a side elevational view including a cross section of part of the cutting apparatus S, FIG. 15 which is a partial enlarged front elevational view of the cutting apparatus S and FIG. 16 which is a side elevational view of the cutting apparatus S on the opposite side to that of FIG. 14.

As shown in FIG. 2, the cutting apparatus S is disposed at a lower end portion of a frame s1 depending on a front face of the base Fb, and a motor s3 with a speed reducer s2 is disposed on the frame s1. A pulley s5 is mounted on an output shaft s4 of the motor c3 which does not have the speed reducer s2 thereon and rotates at a high speed, and a substantially egg-shaped cam s7 is mounted on another output shaft s6 which rotates at a low speed with the speed thereof reduced by the speed reducer s2.

A lever s9 is pivotally mounted on the output shaft s4, which rotates at a high speed, by way of a bearing s8, and since the lever s9 is mounted for pivotal motion on the output shaft s4 by way of the bearing s8, it is not influenced by rotation of the output shaft s4. A horizontal shaft s10 is mounted at a free end portion of the lever s9, and a pulley s13 on which a disk cutter s12 is mounted by way of a bearing s11 is mounted at an end of the horizontal shaft s10 while a guide roller s12' is mounted at the other end of the horizontal shaft s10 by way of a suitable bearing. Meanwhile, a guide member s14 having a horizontal guide groove s14' formed with an increasing width toward an end portion as shown in FIG. 15 is mounted at a free end portion of the lever s9. A belt s15 extends between and along the pulley s5 mounted on the output shaft s4 rotating at a high speed and the pulley s13 mounted for pivotal motion at the end of the horizontal shaft s10 so that the pulley s13 is rotated by high speed rotation of the output shaft s4 by way of the pulley s5 and the belt s15 and accordingly the disk cutter s12 mounted on the pulley s13 is rotated at a high speed.

Meanwhile, a horizontal shaft s16 is mounted at a lower end portion of the frame s1 depending on the front face of the frame Fb, and a lever s17 is mounted for pivotal motion on the horizontal shaft s16. As shown in FIG. 16, a coil spring s18 which is mounted at an end thereof on the frame s1 is mounted at the other end thereof at an end portion of a substantially horizontal portion s17' of the lever s17 so that it biases the lever s17 in the clockwise direction in FIG. 16 around the horizontal shaft s16.

An elongated hole s19 is performed at an end portion of a substantially vertical portion s17" of the lever s17, and a guide roller s12' fitted in an end of the horizontal shaft s10 mounted at the free end portion of the lever s9 is fitted in the elongated hole s19. Meanwhile, a cam follower s21 for contacting under pressure with the substantially egg-shaped cam s7 mounted on the output shaft s6 rotating at a low speed is mounted on a horizontal shaft s20 mounted at an intermediate portion of the lever s17. Since the lever s17 is biased in the clockwise direction in FIG. 16 by the coil spring s18 as described hereinabove, the cam follower s21 is normally held in contact under pressure with the substantially egg-shaped cam s7.

In the following, operation of the cutting apparatus S constructed in such a manner as described above will be described.

When braiding of a braid is completed on the mandrel m and then the mandrel m is moved horizontally in the rightward direction in FIG. 2 across the disk cutter s12 of the cutting apparatus S by the mandrel moving apparatus M for the mandrel apparatus Bm which will be hereinafter described, also a large number of yarns Y connecting to the braid are bent and moved horizontally in the rightward direction while being gathered by the second braiding position stabilizing guide member g2 of the braiding position stabilizing guide member G.

When the motor s3 is energized in a condition wherein the large number of yarns Y bent and gathered by the second braiding position stabilizing guide member g2 and connecting to the braid reach the proximity of the disk cutter s12 of the cutting apparatus S, the disk cutter s12 is rotated at a high speed by way of the pulley s5 mounted on the output shaft s4 rotating at a high speed, the belt s15 and the pulley s13. Meanwhile, upon rotation of the output shaft s6 which is rotated at a low speed by the motor s3 by way of the speed reducer s2, the substantially egg-shaped cam s7 is rotated so that the lever s17 is pivoted from a stand-by position indicated by an alternate long and two short dashes line in FIG. 16 to an operation position indicated by a solid line.

Figure 16:
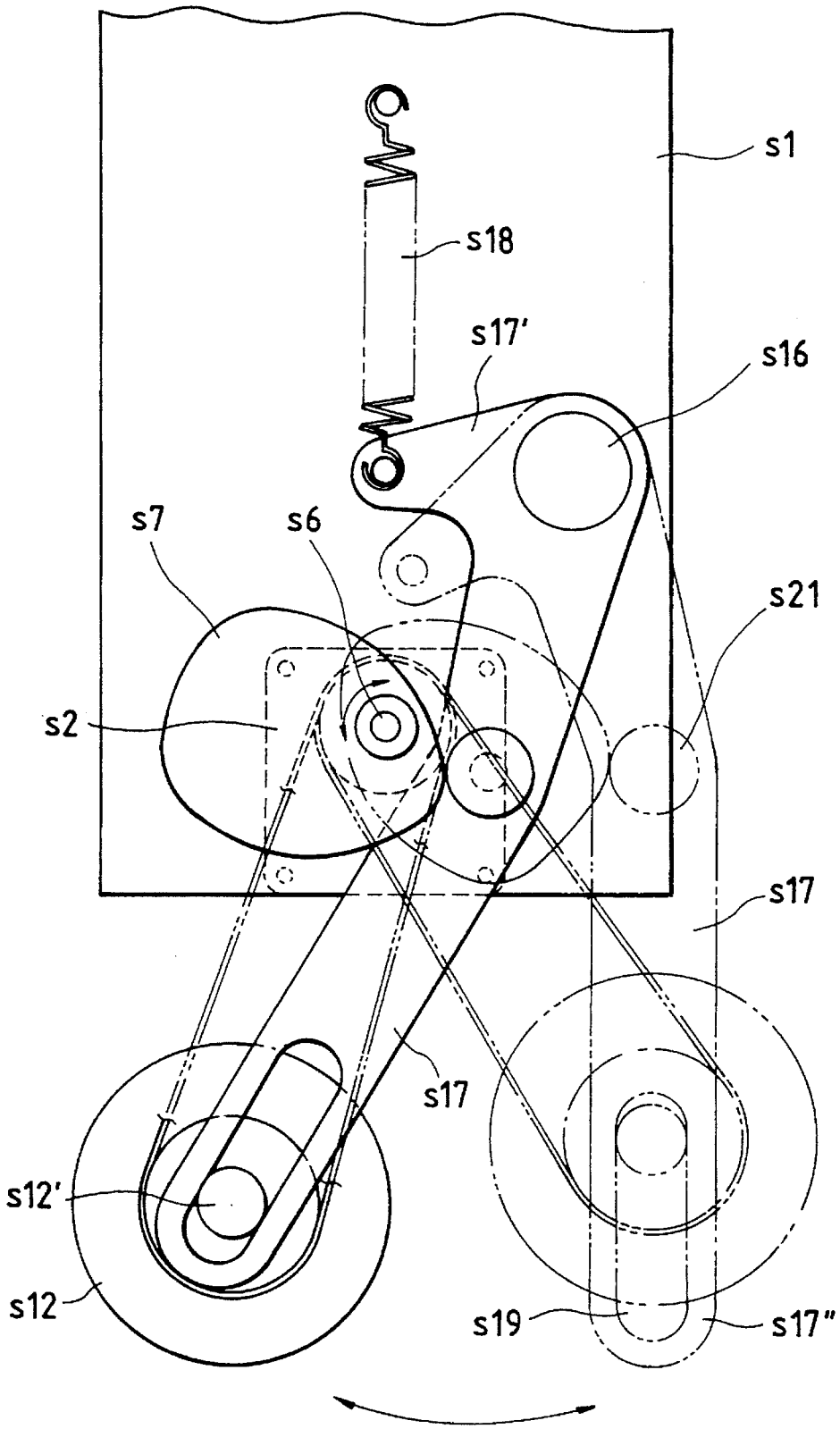
FIG. 16 is a side elevational view of the cutting apparatus on the opposite side to that of FIG. 14.

Upon pivotal motion of the lever s17 in the clockwise direction in FIG. 16, also the lever s9 is pivoted in the clockwise direction in FIG. 16 similarly to the lever s17 by way of the guide roller s12' fitted in the elongated hole s19 of the lever s17. It is to be noted that, in FIG. L6, the lever s9 is omitted. Upon pivotal motion of the lever s9, it guides the large number of yarns Y bent and gathered by the second braiding position stabilizing member g2 and connecting to the braid into the horizontal guide groove s14' of the guide member s14 mounted at the end portion of the lever s9 until they are contacted with the disk cutter s12 mounted on the pulley s13 and rotating at a high speed so that the large number of yarns Y connecting to the braid are cut.

After the large number of yarns Y connecting to the braid are cut, the lever s17 is pivoted in the counterclockwise direction in FIG. 16 by the substantially egg-shaped cam s7 so that it returns to its stand-by position indicated by an alternate long and two short dashes line. Upon pivotal motion of the lever s17 in the counterclockwise direction, also the lever s9 is pivoted in the counterclockwise direction to return to its stand-by position. The conditions wherein the lever s17 and the lever s9 are returned to their stand-by positions are detected by suitable detecting means not shown to stop energization of the motor s3.

It is to be noted that, while the description above relates to the case wherein the large number of yarns Y connecting the braid are cut, it is also possible to cut the braid itself braided long.

Subsequently, the mandrel apparatus Bm will be described principally with reference to FIG. 17 which is a side elevational view of the mandrel apparatus Bm and FIG. 18 which is a schematic enlarged plan view of the mandrel moving apparatus M.

The base Fm of the mandrel apparatus Bm is disposed in front of the braider body Bb as shown in FIGS. 1 and 2, and a horizontally movable frame b1 which is horizontally movable substantially toward the center of the upper plate U of a curved face configuration disposed in the braider body Bb and having the track formed therein is disposed at an upper portion of the base Fm. Recesses b2 are formed on the opposite side walls of the horizontally movable frame b1, and a pair of guide rollers b3, b3' mounted for rotation on horizontal shafts disposed at an upper portion of the base Fm and a pair of guide rollers b4, b4' mounted for rotation on vertical shafts are fitted in each of the recesses b2 as shown in FIG. 17.

Meanwhile, a rack b5 is mounted in parallel to the horizontally movable frame b1 at a lower portion of the horizontally movable frame b1, and a pinion b7 mounted on an output shaft b6' of a bidirectional motor b6 mounted on the base Fm is held in meshing engagement with the rack b5.

Accordingly, by driving the bidirectional motor b6, the pinion b7 is driven to rotate to move the rack b5 held in meshing engagement with the pinion b7 horizontally so that the horizontally movable frame b1 is moved horizontally along the guide rollers b3, b3' and the guide rollers b4, b4'.

A sectoral frame b8 is mounted at an end portion of the horizontally movable frame b1, and a bidirectional motor b9 is disposed on the sectoral frame b8. And, a pinion b10 is mounted on an output shaft b9' of the bidirectional motor b9.

Figure 17:
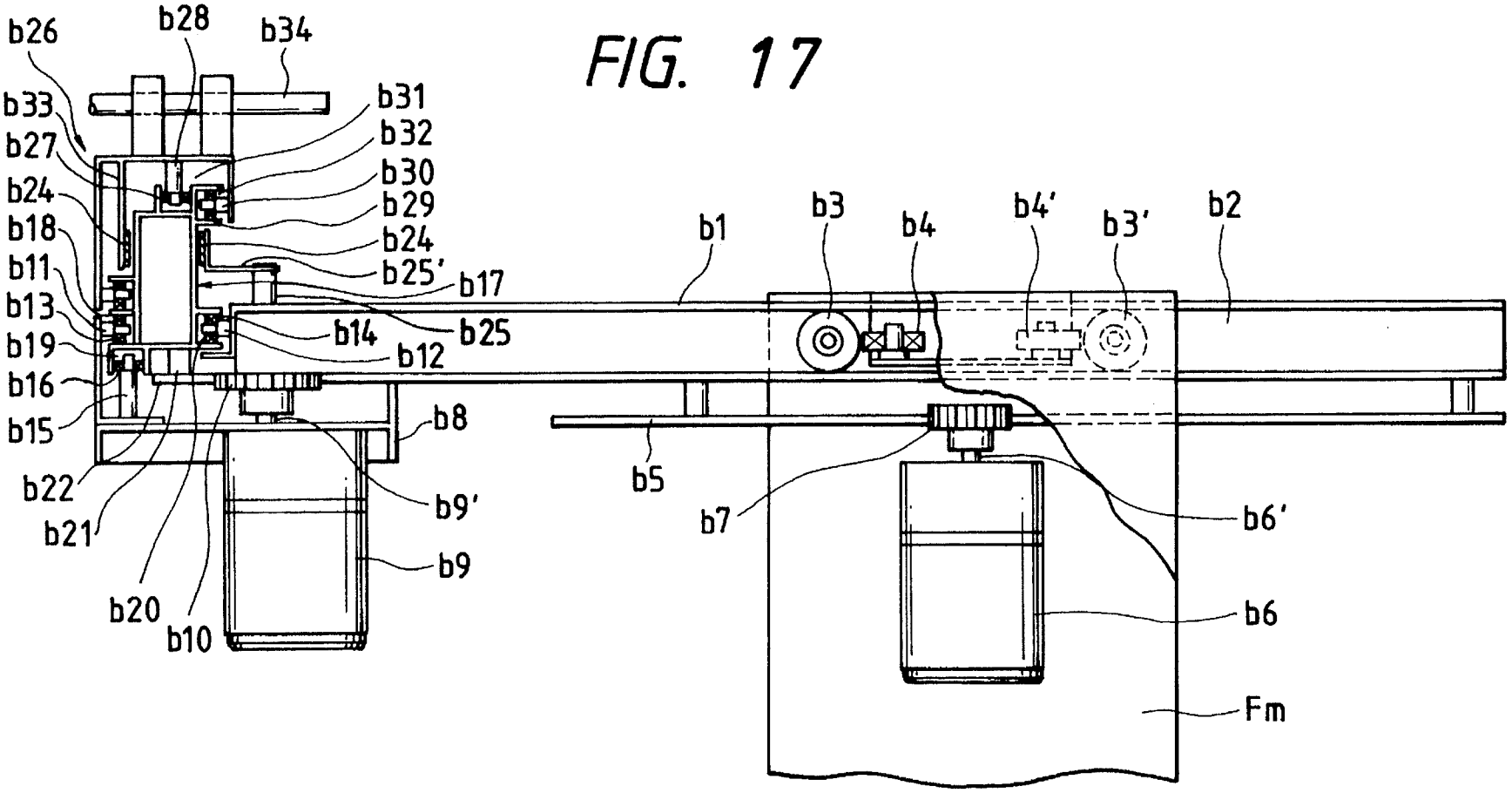
FIG. 17 is a side elevational view of a mandrel apparatus.

Horizontal shafts b11, b12 are mounted at an end portion of the horizontally movable frame b1 and the sectoral frame b8, respectively, as shown in FIG. 17, and guide rollers b13, b14 are mounted on the horizontal shafts b11, b12, respectively. Further, a vertical shaft b15 is provided uprightly on the sectoral frame b8, and a guide roller b16 is mounted on the vertical shaft b15. It is to be noted that a suitable number of such guide rollers b13, b14, b16 are disposed along the longitudinal direction of the sectoral frame b8 so that a sectoral movable member b17 which will be described below can be held stably.

The sectoral movable member b17 is constituted from a frame member having a substantially square cross section as shown in FIG. 17, and a suitable number of edge portions are projected in a horizontal direction or a vertical direction from an outer side wall of the sectoral movable member b17 so as to form rail members b18, b19, b20 with which the guide rollers b13, b14, b16 disposed at the end portion of the horizontally movable frame b1 and the sectoral frame b8 described above are fitted. Meanwhile, a sectoral rack b22 is mounted on a vertical shaft b21 depending from a lower side wall of the sectoral movable member b17, and the pinion b10 mounted on the output shaft b9' of the bidirectional motor 9 described above is engaged with the sectoral rack b22.

Accordingly, when the pinion b10 is driven to rotate by rotation of the bidirectional motor b9 to drive the sectoral rack b22 held in meshing engagement with the pinion b10, the sectoral movable member b17 is moved horizontally while keeping its horizontal condition by the guide rollers b13, b14, b16 disposed at the end portion of the horizontally movable member b1 and the sectoral frame b8 and fitted in the rail members b18, b19, b20 of the sectoral movable member b17.

Figure 18:
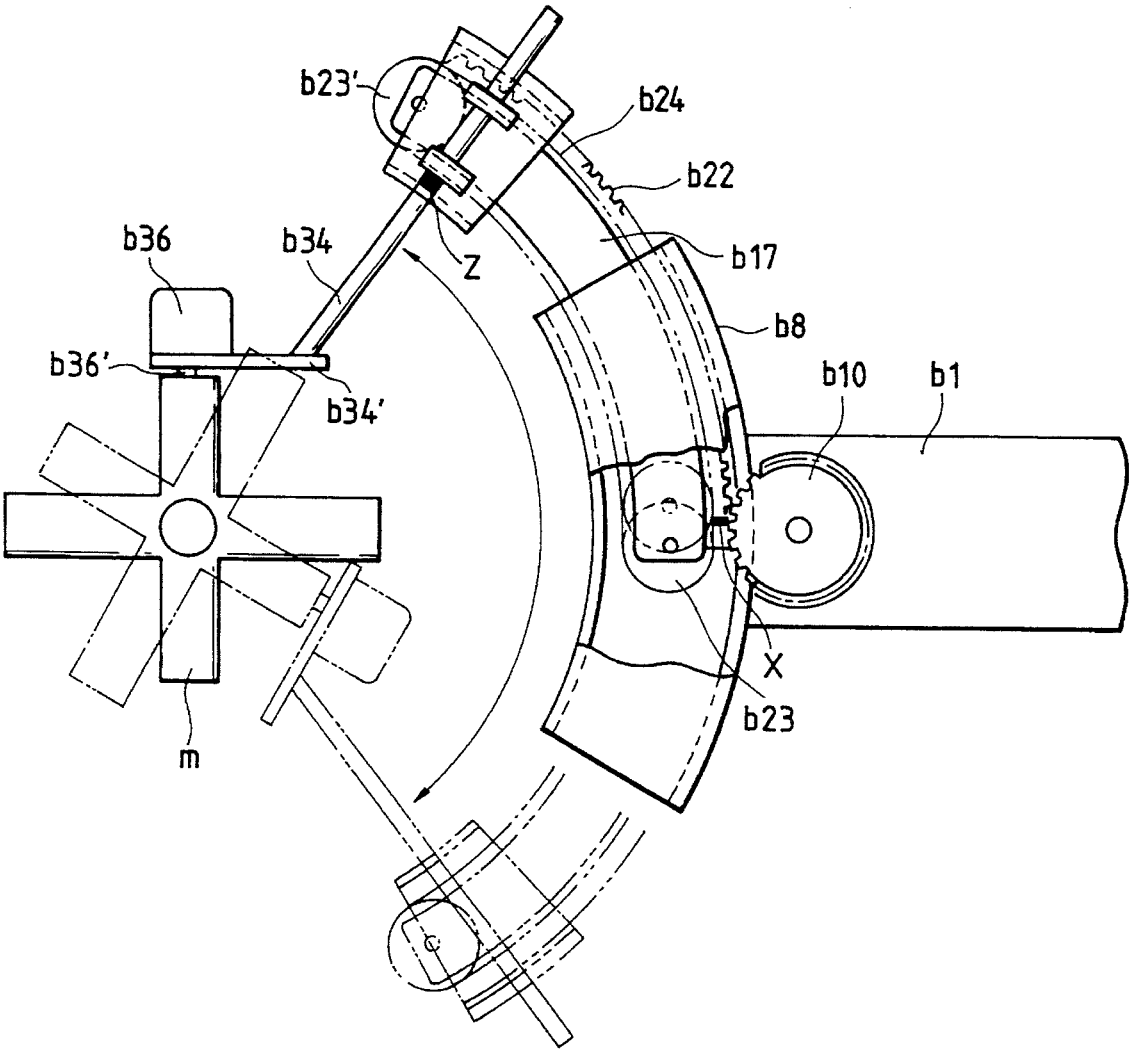
FIG. 18 is a schematic enlarged plan view of a mandrel moving apparatus.

As shown in FIG. 18, pulleys b23, b23' are mounted for rotation at the opposite end portions in a longitudinal direction of the sectoral movable member b17, and an endless belt b24 extends between the pulley b23 and the pulley b23'. And, the endless belt b24 is securely mounted at a location thereof to a frame b25' mounted on a vertical shaft b25 provided uprightly at an end portion of the horizontally movable frame b1 as shown in FIG. 17, and is securely mounted at another location thereof to a mandrel supporting and moving member b26 which will be described below.

Subsequently, the mandrel supporting and moving member b26 will be described.

A vertical shaft b28 having a guide roller b27 mounted at an end thereof and a horizontal shaft b30 having a guide roller b29 mounted at an end thereof are disposed on the mandrel supporting and moving member b26 as shown in FIG. 17, and the guide rollers b27, b29 are fitted in rail members b31, b32 formed from a suitable number of edge portions projecting in a horizontal direction or a vertical direction from the outer side wall of the sectoral movable member b17 described hereinabove. Accordingly, the mandrel supporting and moving member b26 can move horizontally along the rail members b31, b32 of the sectoral movable member b17. It is to be noted that the guide rollers b27, b29 are disposed by a suitable number on the mandrel supporting and moving member b26 so that they may be held stably on the rail members b31, b32 of the sectoral movable member b17.

Meanwhile, a vertical frame b33 depends on the mandrel supporting and moving member b26, and the endless belt b24 is securely mounted at a location thereof on the vertical frame b33 as described hereinabove. It is to be noted that the point X in FIG. 18 indicates a point at which the endless belt b24 is securely mounted on the frame b25' mounted on the vertical frame b25 provided uprightly at the end portion of the horizontally movable frame b1, and the point Z indicates another point at which the endless belt b24 is securely mounted on the vertical frame b33 of the mandrel supporting and moving member b26.

Meanwhile, reference character b34 denotes a support bar removably mounted on the mandrel supporting and moving member b26, and a mandrel mounting plate b34' is mounted at an end portion of the support bar b34. The support bar b34 is mounted by suitable securely mounting means on support frames b26', b26" provided uprightly on the mandrel supporting and moving member b26.

In the following, operation of the mandrel apparatus Bm for controlling motion of the mandrel m upon braiding of a braid will be described.

Horizontal movement of the horizontally movable frame b1 for moving the mandrel m in a horizontal direction toward or away from the upper plate U of a curved face configuration disposed in the braider body Bb and having the track formed therein is performed by energizing the bidirectional motor b6 to rotate as described above so that the pinion b7 is driven to rotate to horizontally move the rack b5 held in meshing engagement with the pinion b7.

Subsequently, movement of the mandrel m in a direction (direction perpendicular to the plane of FIG. 7) substantially perpendicular to the movement in a horizontal direction toward or away from the upper plate U of a curved face configuration will be described.

When the pinion b10 is rotated in the counterclockwise direction in FIG. L8 by rotation of the bidirectional motor b9 from the condition indicated by a solid line in FIG. 18, the sectoral rack b22 held in meshing engagement with the pinion b10 is driven so that the sectoral movable member b17 is moved downwardly in FIG. 18.

When the sectoral movable member b17 is moved downwardly and also the pulley b23 mounted on the sectoral movable member b17 is moved downwardly, since the endless belt b24 is securely mounted at the point X at the end portion of the horizontally movable frame b1, the endless belt b24 on the opposite side with respect to the pulley b23 is drawn downwardly in FIG. 18 to pivot the endless belt b24 in the counterclockwise direction. Since the mandrel supporting and moving member b26 is securely mounted at the point Z on the endless belt b24, pivotal motion of the endless belt b24 in the counterclockwise direction also moves the mandrel supporting and moving member b26 downwardly in FIG. 18. In this instance, due to the construction described above, the mandrel supporting and moving member 26 moves by an amount twice the amount of movement of the pulley b23, and consequently, rapid movement of the mandrel supporting and moving member b26 is allowed.

Further, when the pinion b10 is rotated in the counterclockwise direction in FIG. 18 by rotation of the bidirectional motor b9, the sectoral rack b22 held in meshing engagement with the pinion b10 is driven so that the sectoral movable member 17 is moved further downwardly in FIG. 18 so that the mandrel supporting and moving member b26 can be pivoted to its lowermost position indicated by an alternate long and two short dashes line in FIG. 18. On the other hand, in order to move the mandrel supporting and moving member b26 upwardly from the lowermost position indicated by an alternate long and two short dashes line, the bidirectional motor b9 is rotated reversely to rotate the pinion b10 in the clockwise direction in FIG. 18.

As described above, the posture of the mandrel m can be freely controlled two-dimensionally by horizontal movement of the horizontal moving frame b1 and movement of the mandrel supporting and moving member b26, and the posture of the mandrel m can be controlled three-dimensionally by disposing a suitable actuator b36 or a like element on a mandrel mounting plate b34' mounted at an end portion of the support bar b34 described hereinabove and mounting the mandrel m on an output shaft b36' of the actuator or the like element.

Figure 19:
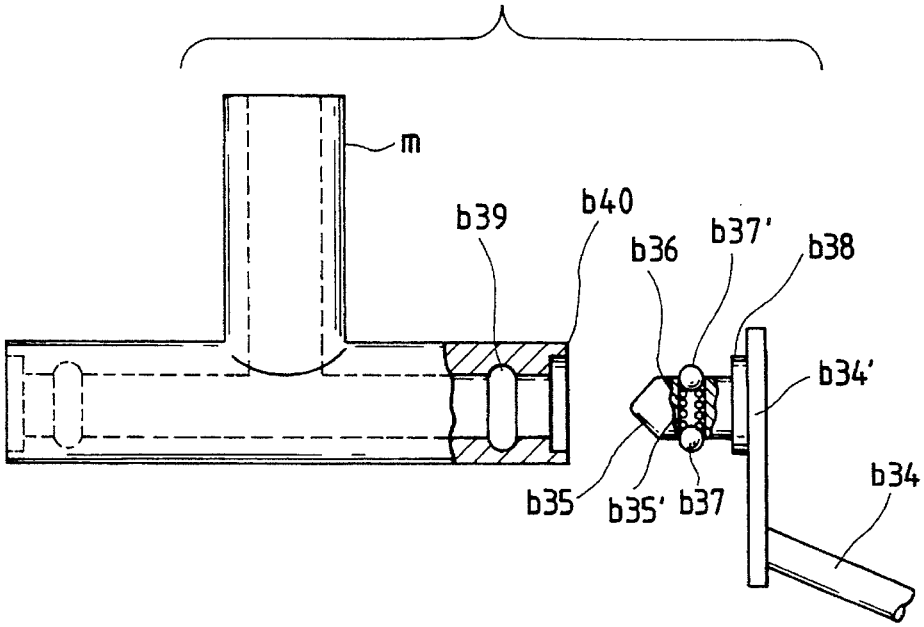
FIG. 19 is a plan view including a partial cross section showing means for mounting the mandrel on a mandrel mounting plate.

FIG. 19 is a plan view showing mounting means for mounting the mandrel m on the mandrel mounting plate b34'.

Referring to FIG. 19, reference character b35 denotes a peg provided uprightly on the mandrel mounting plate b34', and balls b37, b37' are disposed for projecting and retreating movement in a perforation b35' perforated in the peg b35 with a compression coil spring b36 interposed therebetween while a knob b38 is provided projectingly at a root of the peg b35. Meanwhile, a circumferential groove b39 in which the balls b37, b37' provided on the peg b35 can be fitted is formed in the proximity of an end portion of an opening of the hollow mandrel m, and a groove b40 into which the knob b38 disposed at the root of the peg b35 can be inserted is formed at an end portion of the opening of the hollow mandrel m.

Accordingly, by fitting the hollow mandrel m onto the peg b35 and fitting the balls b37, b37' provided on the peg b35 into the circumferential groove b39 formed in the proximity of the end portion of the opening of the hollow mandrel m, the mandrel m can be mounted simply onto the mandrel mounting plate b34', and by inserting the knob b38 provided projectingly at the root of the peg b35 into the groove b40 formed at the end portion of the opening of the hollow mandrel m, the mandrel m can be prevented from rotating relative to the mandrel mounting plate b34'.

Figure 20:
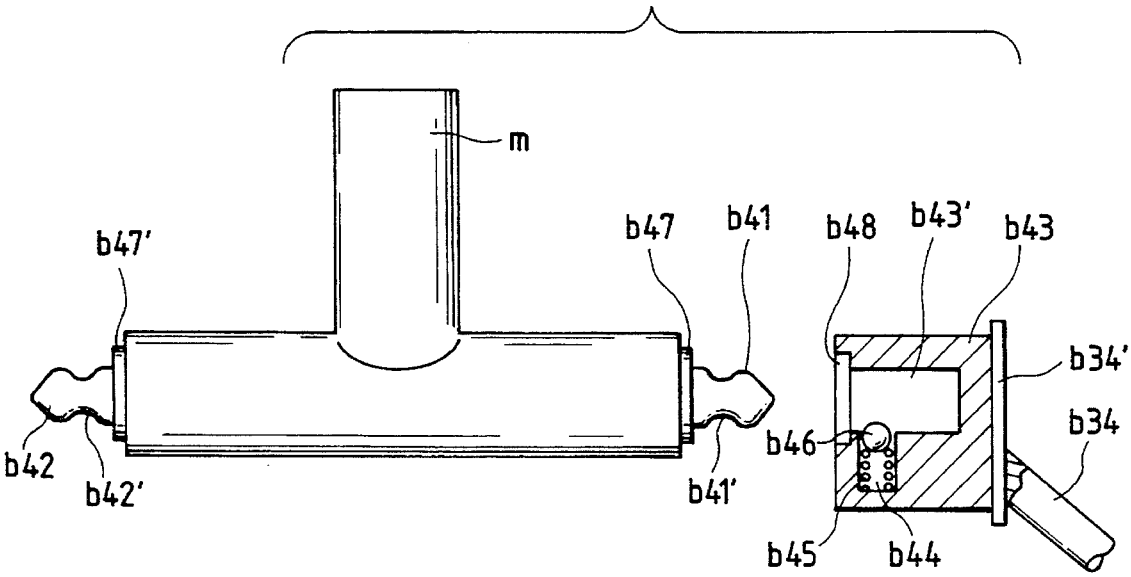
FIG. 20 is a plan view including a partial cross section of another embodiment showing means for mounting the mandrel on the mandrel mounting plate.

FIG. 20 is a plan view of another embodiment showing the mounting means for mounting the mandrel m onto the mandrel mounting plate b34'.

In the mounting means shown in FIG. 20, pegs b41, b42 having circumferential grooves b41', b42' are mounted on the end portion sides of the mandrel m, and a female member b43 having a recess b43' into which the peg b41, b42 can be inserted is mounted on the mandrel mounting plate b34' side. A depression b44 is provided at the recess b43' of the female member b43, and a compression coil spring b43 is mounted in the depression b44 and also a ball b46 is mounted in the depression b44 so that the ball b46 may project from and retreat into the depression b44 by way of the compression coil spring b45. It is to be noted that reference characters b47, b47' denote knobs provided projectingly at roots of the pegs b41, b42, respectively, and the knob b47, b47' is fitted in a groove b48 formed in the opening of the female member b43 to prevent the mandrel m from rotating relative to the mandrel mounting plate b34'.

Accordingly, by inserting the peg b41, b42 of the mandrel m into the recess b43' of the female member b43 and fitting the ball b46 biased by the compression coil spring b45 into the circumferential groove b41', b42' of the peg b41, b42, the mandrel m can be mounted simply onto the mandrel mounting plate b34'.

Subsequently, a sequence of steps of braiding a braid on such a T-shaped mandrel m as shown in FIG. 18 as an example using the braider BR of the present invention will be described with reference to FIGS. 21 to 23 which are schematic plan views illustrating braiding steps.

Figure 21A:
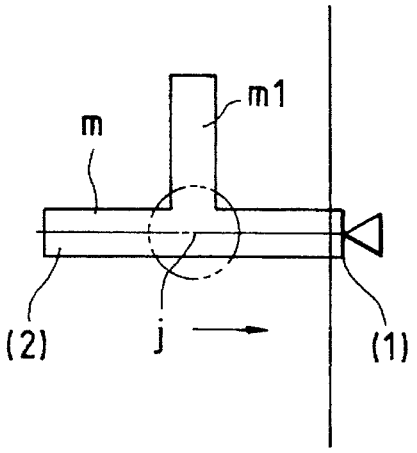
FIGS. 21A to 21F are plan views of the mandrel illustrating braiding steps for a braid.

(a) First, in a condition wherein the braider body Bb is stopped from being driven and the bobbin carrier C is stopped from travelling, the horizontally movable frame b1 is moved in the rightward direction in FIG. 2 to mount one end (1) of the T-shaped mandrel m (hereinafter referred to merely as "mandrel m": meanwhile, a minor portion ml of the T-shaped mandrel m which extends perpendicularly to a major portion of the T-shaped mandrel m will be hereinafter referred to as "branched portion") onto the mandrel mounting plate b34' shown in FIG. 18. Thereafter, the horizontally movable frame b1 is moved in the leftward direction in FIG. 2 while the sectoral movable member b17 is moved suitably so that the braiding point P may be positioned at the one end (1) of the mandrel m as shown in FIG. 21A (it is to be noted that, for the convenience of illustration, an inverted triangular mark (▽) is applied to the end portion of the mandrel m at which the mandrel m is mounted on the mandrel mounting plate b34').

Figure 21D:
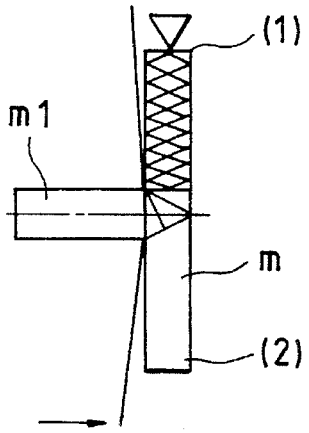
Figure 21B:
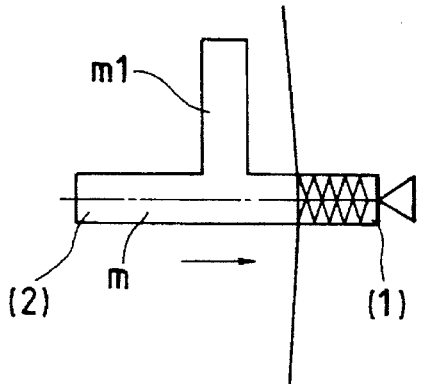

(b) From this condition, the driving apparatus D is energized to drive the bobbin carriers C to travel along the track to start braiding so that the horizontally movable frame b1 is gradually moved in the rightward direction in FIG. 2 to perform braiding toward a joining portion j of the mandrel m as shown in FIG. 21B.

Figure 21E:
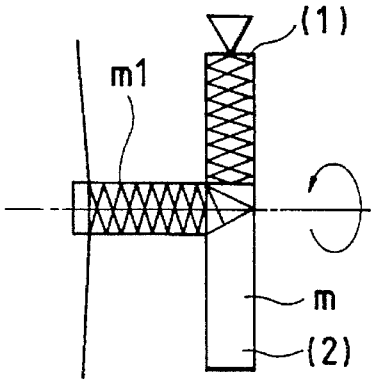
Figure 21C:
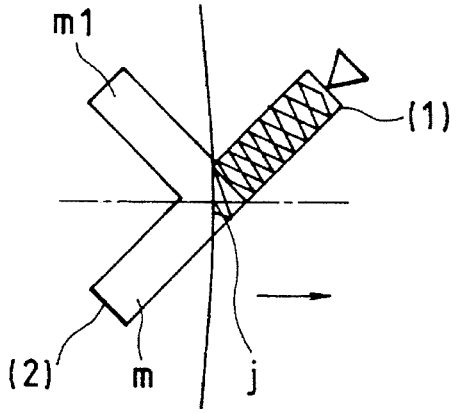

(c) After braiding is performed up to the joining portion j of the mandrel m, the movement of the horizontally movable frame b1 is stopped, and then, the sectoral movable member b17 is moved upwardly in FIG. 18 and the mandrel m is rotated in such a manner shown in FIG. 21C into a condition shown in FIG. 21D. From this condition, the horizontally movable frame b1 is further moved in the rightward direction in FIG. 2 to braid the branched portion ml of the mandrel m as shown in FIG. 21E. It is to be noted that it is also possible to decrease the speed of movement of the horizontally movable frame b1 without stopping movement of the same while the sectoral movable member b17 is moved simultaneously.

Figure 21F:
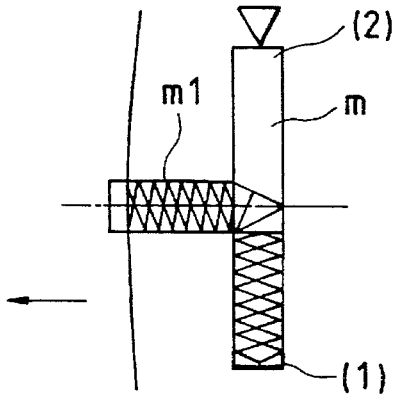

(d) As shown in FIG. 21E, the movement of the horizontally movable frame b1 is stopped and the driving apparatus D is stopped to stop the travelling of the bobbin carriers C when braiding proceeds to an end portion of the branched portion m1 of the mandrel m. Then, as shown in FIG. 21F, the one end (1) of the mandrel m is removed from the mandrel mounting plate b34' and the mandrel m is rotated by 180 degrees, and then one end (2) of the mandrel m on the opposite side to the one end (1) is attached to the mandrel mounting plate b34'.

Figure 22A:
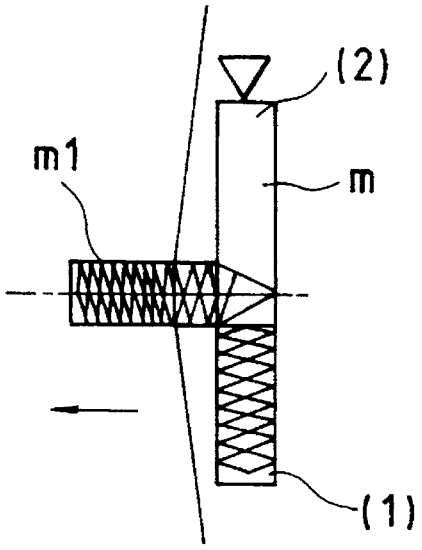
FIGS. 22A to 22D are plan views of the mandrel illustrating braiding steps for a braid similarly to FIG. 21.
Figure 22C:
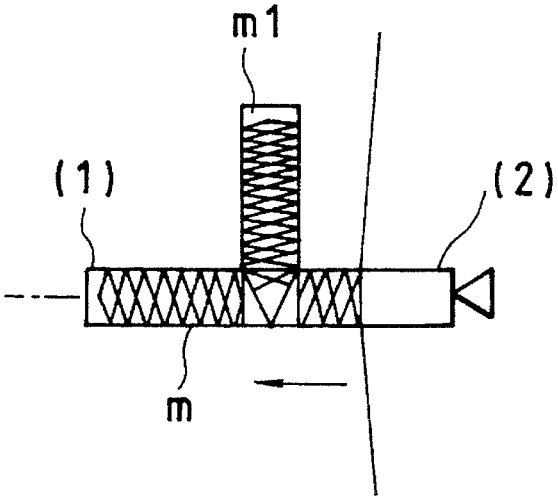

(e) After the one end (2) of the mandrel m is attached to the mandrel mounting plate b34', driving of the driving apparatus D is re-started to start travelling of the bobbin carriers C while the horizontally movable frame b1 is moved in the leftward direction in FIG. 2 so that the branched portion ml of the mandrel m is braided again as shown in FIG. 22A.

Figure 22B:
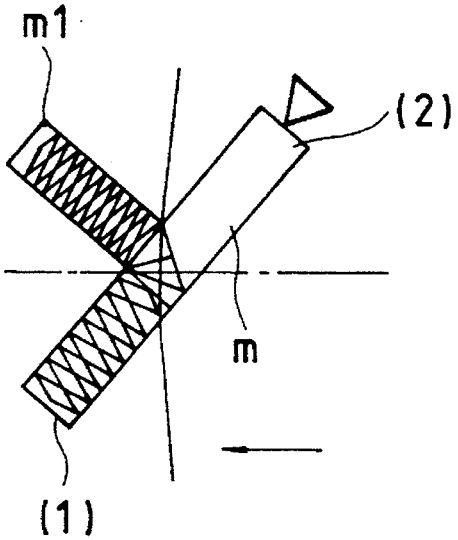

(f) After braiding proceeds to the joining portion j of the mandrel m, the driving apparatus D is stopped to stop the travelling of the bobbin carriers C while the movement of the horizontally movable frame b1 is stopped, and then the sectoral movable member b17 is moved downwardly in FIG. 18, whereafter the mandrel m is rotated to a condition shown in FIG. 22B. In this condition, the driving apparatus D is energized to restart travelling of the bobbin carriers C to start braiding, and the sectoral movable member b17 is moved further downwardly into a condition shown in FIG. 22C, whereafter the horizontally movable frame b1 is moved in the leftward direction in FIG. 2 and braiding is performed up to an end portion of the mandrel m as shown in FIG. 22D.

Figure 22D:
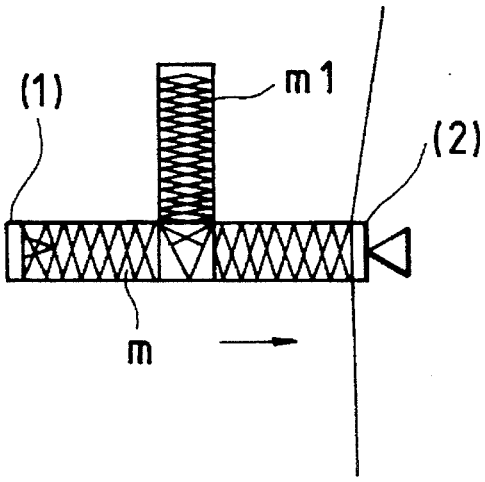
Figure 23A:
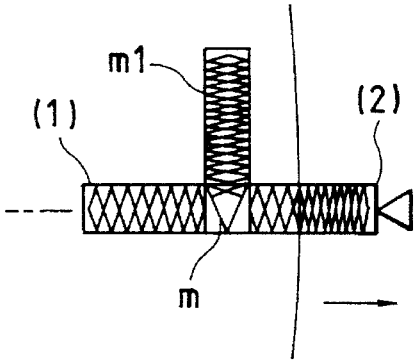
FIGS. 23A to 23F are plan views of the mandrel illustrating braiding steps for a braid similarly to FIG. 21.

(g) After braiding proceeds up to the end portion of the mandrel m as shown in FIG. 22D, the horizontally movable frame b1 is moved in the rightward direction in FIG. 2 and braiding is performed toward the joining portion j of the mandrel m as shown in FIG. 23A.

Figure 23D:
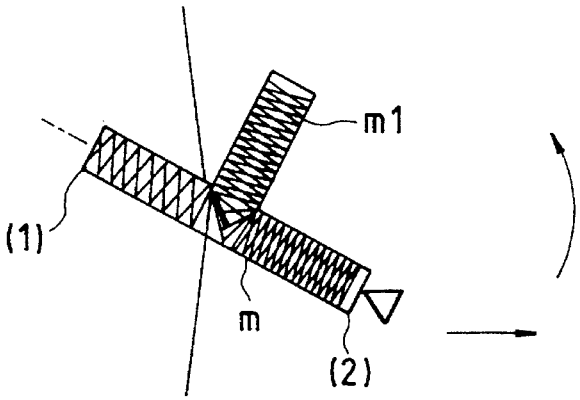
Figure 23B:
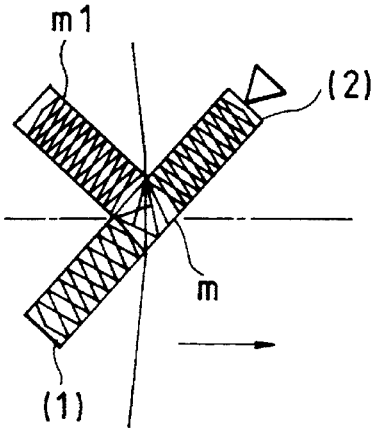

(h) In a condition wherein braiding proceeds to the proximity of the joining portion j of the mandrel m, the horizontally movable frame b1 is moved in the rightward direction in FIG. 2 while the sectoral movable member b17 is moved upwardly into a condition shown in FIG. 23B, and in this condition, the movement of the horizontally movable frame b1 is stopped and the driving apparatus D is deenergized to stop the travelling of the bobbin carriers C.

(i) Subsequently, the sectoral movable member b17 is moved downwardly to put the mandrel m into a condition shown in FIG. 23C. Thereafter, energization of the driving apparatus D is re-started to start travelling of the bobbin carriers C, and the horizontally movable frame b1 is moved in the rightward direction in FIG. 2 to perform braiding of the joining portion j of the mandrel m as shown in FIG. 23D.

Figure 23E:
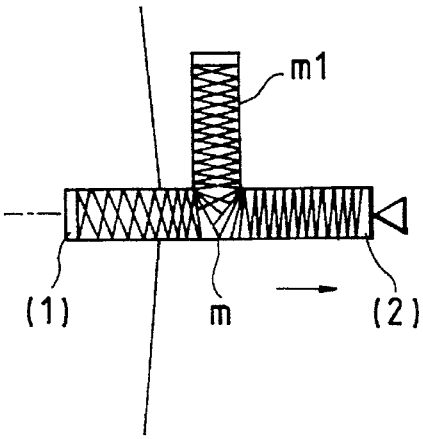
Figure 23C:
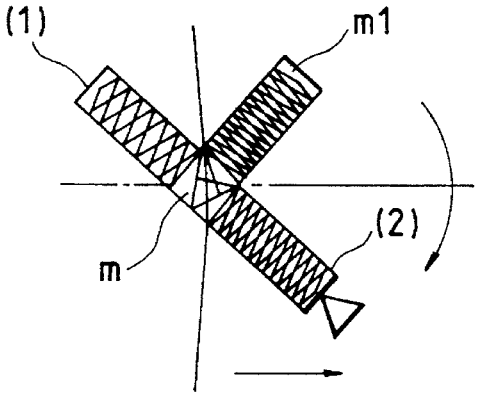
Figure 23F:
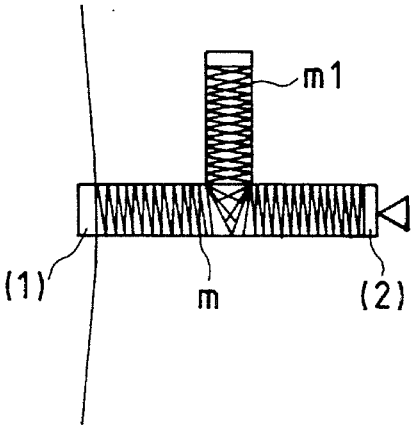

(j) Subsequently, the sectoral movable member b17 is moved upwardly to put the mandrel m into such a condition as shown in FIG. 23E, and the horizontally movable frame b1 is moved in the rightward direction in FIG. 2 to perform braiding up to an end portion of the mandrel m as shown in FIG. 23F, thereby completing braiding on the mandrel m.

(k) After braiding on the mandrel m is completed, the driving apparatus D is deenergized to stop the travelling of the bobbin carriers C.

(1) Subsequently, the horizontally movable frame b1 is moved to a great extent in the rightward direction in FIG. 2 to move the mandrel m to a position beyond the disk cutter s12 of the cutting apparatus S. From this condition, the motor s3 is rotated to rotate the disk cutter s12 at a high speed as described above. Meanwhile, upon rotation of the output shaft s6 which is rotated at a low speed by the motor s3 by way of the speed reducer s2, the lever s17 is pivoted from the stand-by position indicated by an alternate long and two short dashes line in FIG. 16 to the operation position indicated by a solid line. As the pivoting motion of the lever s17 in the clockwise direction in FIG. 16 proceeds, the lever s9 is pivoted toward the operation position similarly to the lever s17. By the pivotal motion of the lever s9, the large number of yarns Y bent and gathered by the second braiding point stabilizing guide member g2 and connecting to the braid are guided into the horizontal guide groove s14' of the guide member s14 mounted at the end portion of the lever s9 to be contacted with the disk cutters s12 mounted on the pulley s13 and rotating at a high speed so that the large number of yarns Y connecting to the braid are cut by the disk cutter s12.

The overall steps of the braiding procedure are completed with this.

It is to be noted that the braiding steps of (a) to (1) described above only indicate an example, and braiding can be performed on the T-shaped mandrel m by way of various steps including the moving and stopping sequence for the horizontally movable frame b1 and the sectoral movable member b17 and the steps cannot be limited to those braiding steps described above.

When it is tried at the step (d) described above to remove the one end (1) of the mandrel m from the mandrel mounting plate b34', rotate the mandrel m by 180 degrees and mount the other end (2) of the mandrel m onto the mandrel mounting plate b34', the mandrel m can be mounted simply onto the mandrel mounting plate b34' by the mounting means for mounting the mandrel m onto the mandrel mounting plate b34' described hereinabove with reference to FIGS. 19 and 20, and consequently, the present step can be performed rapidly.

Figure 27:
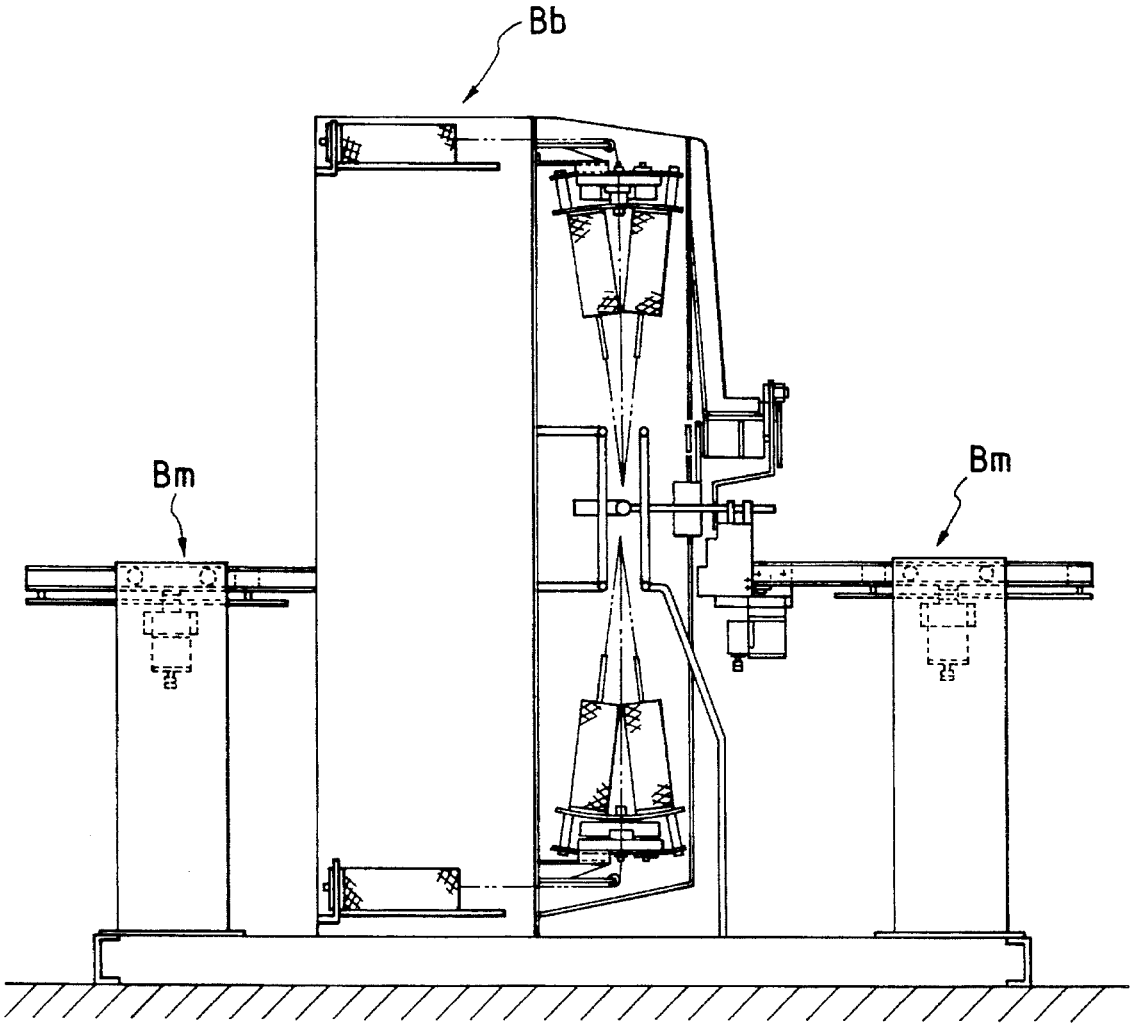
FIG. 27 is a view showing an example wherein a pair of mandrel apparatus are disposed.

Meanwhile, by disposing another mandrel apparatus on the opposite side of the mandrel apparatus Bm to the upper plate U of a curved face configuration as shown in FIG. 27, the mandrel m can be mounted onto the mandrel mounting plate b34' of the other mandrel apparatus to continue braiding simultaneously with removal of the mandrel m from the mandrel mounting plate b34' of the mandrel apparatus Bm. By disposing the two mandrel apparatus in this manner, a mandrel m to be used at a next braiding step can be mounted onto a mandrel apparatus to make preparations.

While the case wherein braiding is performed on the T-shaped mandrel m is described in the embodiment described above, the mandrel is not limited to the T-shaped mandrel m and braiding can be performed on a mandrel m of any of various configurations.

Meanwhile, where a bar-shaped mandrel m is used, a plurality of braider bodies Bb may be disposed to braid a multiple braid on the bar-shaped mandrel m.

In the following, actiona and effects presented by the embodiment of the present invention described above are listed.

Since the braiding point on the mandrel is at the position at which the axial lines of the bobbins placed on the bobbin carriers and the axial line of the mandrel on which braiding is performed intersect with each other, the yarns unwound from the bobbins are not bent at all, and accordingly, the yarns can be unwound smoothly, and since no excessive tension is applied to the yarns at all, a braid can be braided appropriately.

Since the braiding point on the mandrel is at the position at which the axial lines of the bobbins placed on the bobbin carriers and the axial line of the mandrel on which braiding is performed intersect with each other, the braider is reduced in size, and consequently, the operability of the braider is enhanced and the installation area of the braider is reduced.

Since the volume of the yarns wound on the bobbins can be increased, the number of replacing operations of the bobbins is decreased, and accordingly, the productivity of the braider can be enhanced.

Due to the construction wherein the bobbin carriers are driven to travel by the friction rollers and the sliding friction rollers, production of noise arising from a backlash of teeth of gears can be prevented.

Since the braiding position stabilizing guide member is disposed, rocking motion of the yarns which are rocked by movement in lateral directions of the bobbin carriers which travel in a zigzag pattern along the track formed in the upper plate can be restricted and a fluctuation of the braiding point by the movement of the mandrel can be suppressed, and consequently, the yarns used for braiding are not crossed in an irregular condition with each other in the proximity of the braiding point and stabilized braiding can be realized. Accordingly, the shape of a braid thus braided is uniform, and the stabilized braid can be produced.

Meanwhile, since the braiding position stabilizing guide member is disposed, when the mandrel is moved after braiding is completed, the large number of yarns connecting to the thus braided braid can be gathered by the second braiding position stabilizing guide member, and consequently, cutting of the yarns by the cutting apparatus can be performed effectively.

Since the mandrel can be mounted simply and rapidly onto the mandrel mounting plate, the productivity of the braider can be enhanced.

Since the cylindrical bobbin cover or the resilient plate is provided, such a trouble that, when a bobbin carrier is inclined or positioned inversely, the yarn wound on the bobbin is drawn out or suspended so that it becomes entangled with the yarn wound on an adjacent bobbin or entangled with some other member of the braider or the like or a like trouble can be prevented.

Since a bobbin is used commonly for a bobbin to be placed on a bobbin carrier and another bobbin on which a yarn for a core yarn or for reinforcement is wound, there is no need of making a distinction between a bobbin on which a yarn for a core yarn or for reinforcement is wound and another bobbin to be placed onto a bobbin carrier.

Since the cutting apparatus having the disk cutter for cutting a braid for which braiding has been completed or the yarns connecting to the braid is provided, the braid or the yarns connecting to the braid can be cut with certainty and the cutting time can be reduced. Meanwhile, since the tension to be applied to the yarns upon cutting of the braid or the yarns connecting to the braid can be reduced, deformation of the shape of the braid can be prevented.

Since the present invention is constructed in such a manner as described above, the following effects are exhibited.

Since the mandrel is disposed in the inside of the tracks formed in the upper plate of a curved face configuration, the yarns unwound from the bobbins are not bent at all, and accordingly, the yarns can be unwound smoothly, and since no excessive tension is applied to the yarns at all, a braid can be braided appropriately.

Since the mandrel is disposed in the inside of the tracks formed in the upper plate of a curved face configuration, the braider is reduced in size and is improved in operability thereof and the installation area of the braider is reduced.

Since control of the position of the mandrel is performed by pivotal motion around the braiding point and linear movement in the direction toward the braiding point, the mandrel can be moved to an arbitrary position without depending upon movement of the mandrel by a great amount in one direction.

Figure 24:
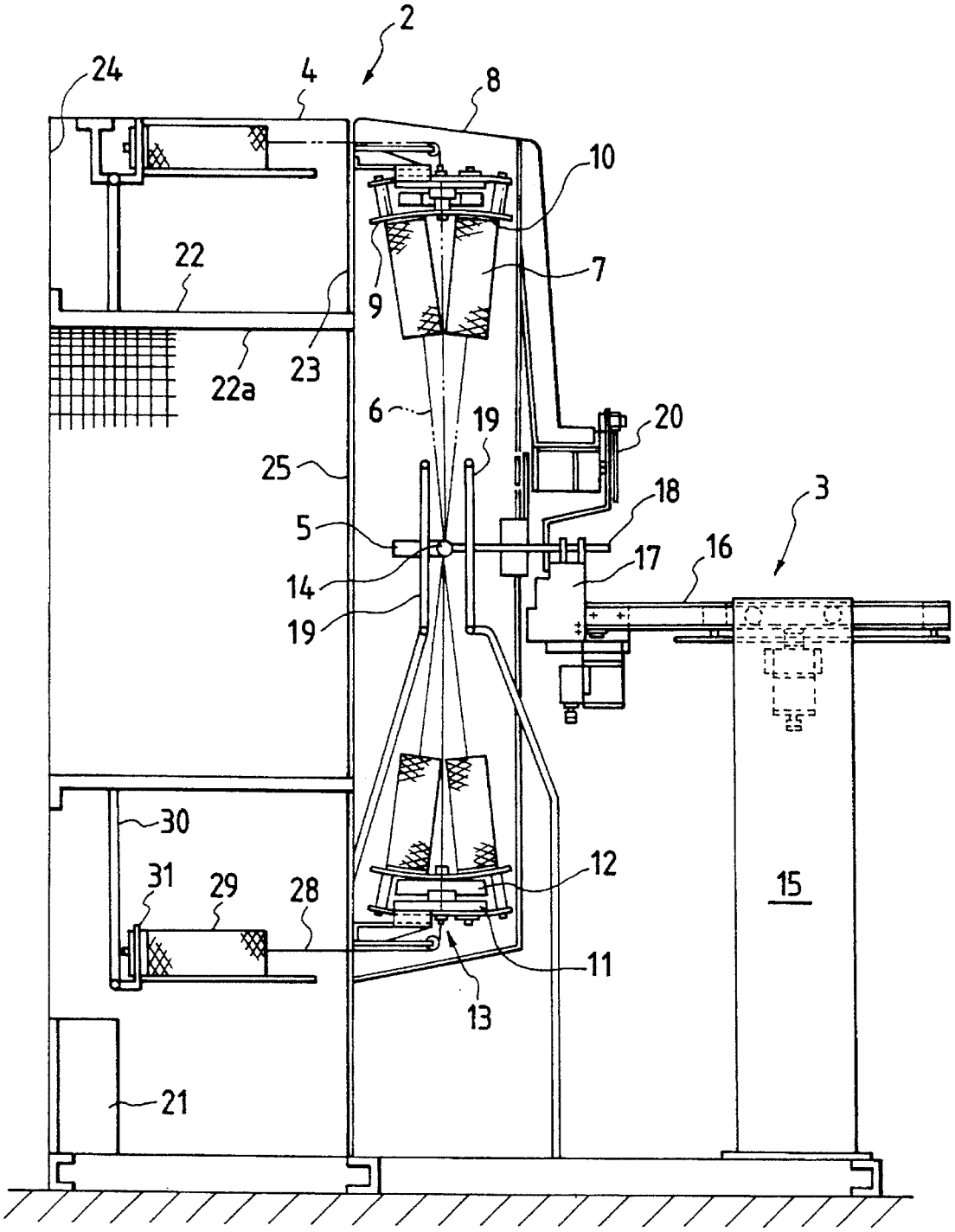
FIG. 24 is a side elevational view of a braider showing another embodiment of the present invention.
Figure 25:
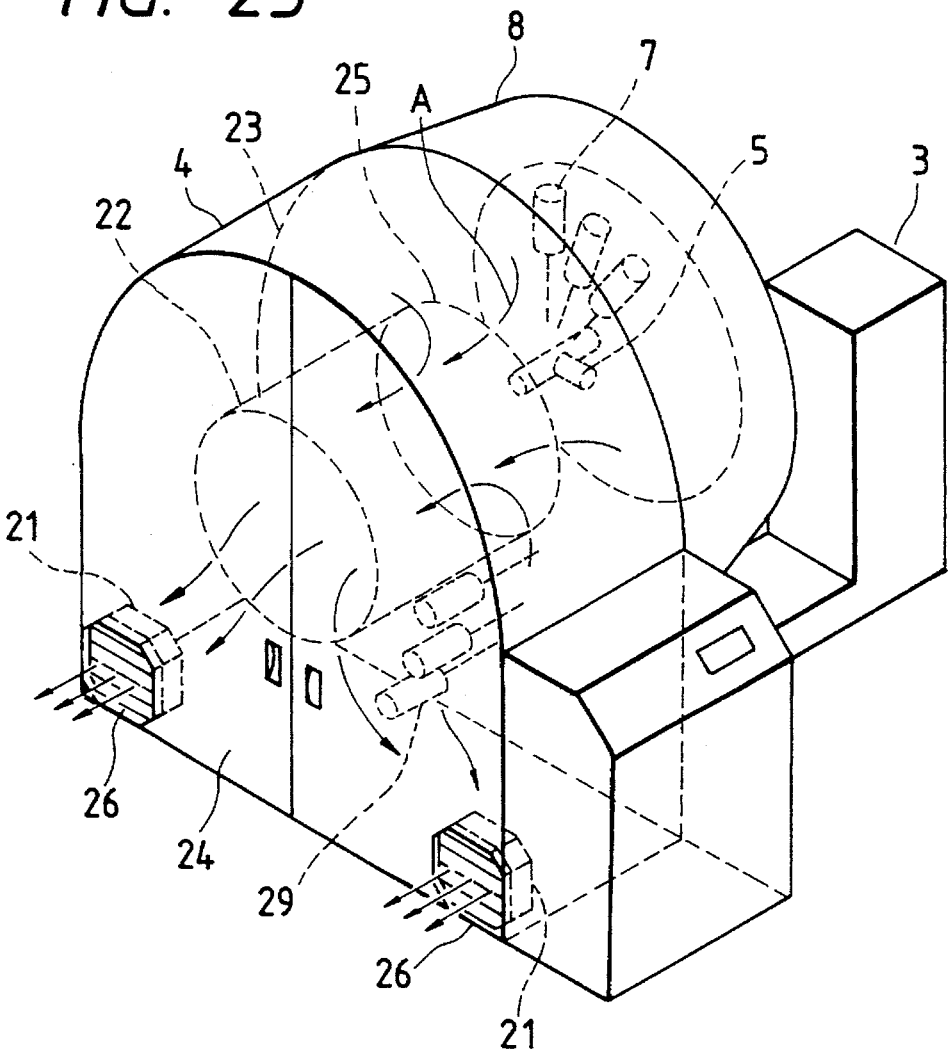
FIG. 25 is a perspective view of the braider.
Figure 26:
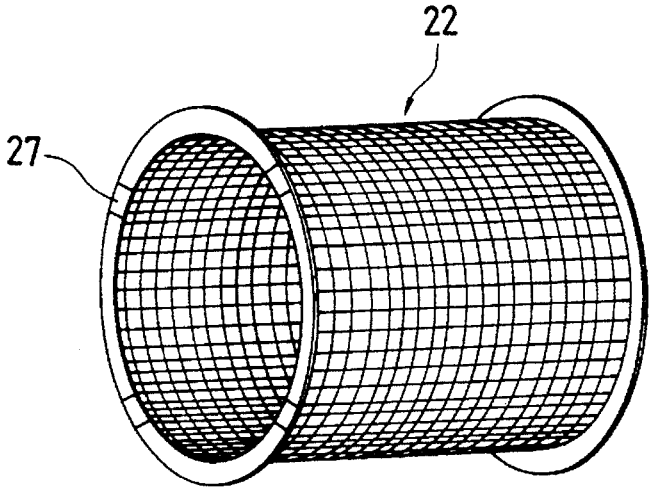
FIG. 26 is a perspective view of a filter.

FIGS. 24 to 26 show another embodiment of the present invention. In the following, details of the embodiment will be described with reference to the drawings.

FIG. 24 shows a side elevational view of a braider 1. The braider is constituted from a braider body 2 and a mandrel apparatus 3. The braider body is constituted from a base 4 in the inside of which a dust collecting apparatus of the present invention is positioned, and a cylindrical wall 8 in the inside of which bobbins 7 on which yarns 6 to be crossed with each other on the surface of a mandrel 5 supported on the mandrel apparatus 3 are wound are positioned.

A track plate 9 having a cylindrical spherical face is installed on an inner face of the cylindrical wall 8, and travelling tracks for bobbin carriers 10 are formed in the track plate 9. And, transporting disks 13 for the bobbin carriers 10 each including a friction roller 11 provided at a lower portion and a vane wheel 12 provided at an upper portion for engaging with a bobbin carrier 10 are provided contiguously to each other between the cylindrical wall 8 and the track plate 9. By driving one of the transporting disks at a location by means of a motor, the contiguous transporting disks are rotated to cause the plurality of bobbin carriers 10 to travel along the bobbin carrier track on the track plate 9. The bobbins 7 are placed on the bobbin carriers 10, and the yarns 6 are supplied from the bobbins 7 toward a braiding point 14 at the central point of the track plate 9.

Meanwhile, the mandrel apparatus 5 is disposed in front of the braider body 2. The mandrel apparatus 5 is constituted from a mandrel apparatus base 15, a horizontally movable body 16 installed on the mandrel apparatus base 15 for movement toward and away from the braider body 2, and a sectoral movable member 17 installed at an end portion of the horizontally movable body 16, and the mandrel is grasped by a mandrel support bar 18 extending from the sectoral movable member 17. The sectoral movable member 17 is movable on a circle centered at the braiding point 14 when the mandrel 5 grasped by the mandrel support bar 18 is positioned at the braiding point 14, and the mandrel 5 can be moved toward and away from the braiding point 14 and can be rotated at the braiding point 4 by the mandrel apparatus 3 described above.

Meanwhile, annular braiding position stabilizing guides 19 are installed in front of and behind the braiding point 14, and the yarns 6 which are rocked upon movement in lateral directions of the bobbin carriers 10 which travel in a zigzag pattern on the locus plate 9 are guided by the braiding position stabilizing guides 19 to stabilize the braiding point 14 to a substantially fixed position. Further, on a front face of the cylindrical wall 8, a cutter 20 for cutting the yarns from the mandrel 5 upon completion of braiding is disposed.

And, a dust collecting apparatus is installed in the inside of the base 4 of the braider body 2. The dust collecting apparatus is constituted from a pair of fans 21 for producing air flows for sucking dust produced in a braid braiding process, and a filter 22 for catching the thus sucked dust.

The filter 22 has a cylindrical configuration and is held at the opposite end faces thereof on a front wall 23 and a rear wall 24 of the base 4 such that the braiding point 14 may be positioned substantially on an imaginary center line of the filter 22. Further, the fan 21 is installed at a low location of a rear portion of the base. In the meantime, a dust inlet opening 25 of a diameter equal to the inner diameter of the filter 22 is opened at a position of the front wall 23 of the base 4 corresponding to the cylindrical face of the filter, and an exhaust port 26 is opened in the rear wall 24 of the base 4 corresponding to the installation position of the fan 21. The rear wall 24 of the frame 4 is in the form of an openable and closeable door, and the filter 22 is held for movement into and out of contact with the rear wall by means of a magnet 27.

Meanwhile, bobbins 29 for core yarns disposed linearly in a longitudinal direction of a braid are held in the base 4 on an annular fixing ring 30 mounted on an inner face of the base 4. It is to be noted that the bobbins 29 for core yarns mentioned above are not provided for exclusive use for core yarns 28, but the bobbin carriers 10 which travel on the locus plate 9 can be used for bobbin carriers for core yarns by anchoring the bobbin carriers 10 on anchors 31 provided on the bobbin fixing ring 30.

Braiding of a braid is performed such that the yarns 6 supplied from the plurality of bobbins 7 travelling on the locus plate 9 are crossed with each other on the mandrel 5 supported at the braiding point 14 by the mandrel apparatus 3. And, in connection with the progress of the braiding or the profile of the mandrel 5, the mandrel 5 performs advancing or retreating movement or pivotal motion at the braiding point 14 by means of the mandrel apparatus 3.

Meanwhile, during braiding, the fan 21 installed in the base 4 is driven so that suction air flows (an arrow mark A) toward the dust inlet opening 25 are produced at the braiding point 14. The suction air flows enter from the dust inlet opening 25 into the base 4 and then exhausted from the exhaust port 26 past the filter 22. Dust produced in the neighborhood of the braiding point 14 is sucked from the dust inlet opening 25 into the base 4 by the suction air flows and is caught by an inner face 22*a* of the filter 22. And, after dust is accumulated to some degree on the filter 22, either the frame rear wall 24 should be opened to collect the dust accumulated on the filter 22 or to exchange the filter 22 itself.

It is to be noted that, while the braider which employs a mandrel is described in the embodiment described above, the dust collecting apparatus of the present invention is not limited to the embodiment described above.

As described so far, with the dust collecting apparatus for a braider according to the present invention, since dust produced during braiding of a braid is sucked by suction air flows produced by the fan and is then caught by the filter, it will not be scattered around the braider, and collection of the dust can be performed only by cleaning the filter and besides it is prevented that the dust contacts with the body of an operator and makes the operator have a disagreeable feeling.

What is claimed is:

1. A braider, comprising:

a plate having at least one of a substantially curved surface and a substantially cylindrical surface and having at least one track formed therein, the track defining a perimeter, at least one bobbin carrier adapted for travelling along the track, at least one mandrel apparatus having a mandrel supporting and moving member for holding a mandrel and for turning the mandrel horizontally relative to a braiding point located substantially within the perimeter defined by the track, the mandrel apparatus comprising:

a first frame mounted for substantially linear, horizontal movement toward and away from the braiding point, a second frame mounted on the first frame and being movable in a substantially horizontal plane relative to the first frame, the mandrel supporting and moving member being supported on the second frame.

2. The braider of claim 1, comprising at least two mandrel apparatus disposed on substantially opposing sides of the braiding point.

3. The braider of claim 1, wherein the mandrel defines a position and an orientation, and comprising:

an actuator for controlling the position and orientation of the mandrel in three-dimensions, the actuator being disposed on the mandrel supporting and moving member and having an output shaft on which the mandrel is mountable.

4. The braider of claim 1, wherein the mandrel supporting and moving member defines a path of movement on the frame, and wherein the path of movement on the frame defined by the mandrel supporting and moving member corresponds substantially to an arc substantially centered at the braiding point.

5. The braider of claim 1, wherein the bobbin carrier defines a first substantially axial line, the mandrel defines a second substantially axial line, the first and second axial lines define a point of intersection, the braiding point is located substantially at the point of intersection, and further comprising:

a braiding position stabilizing guide disposed substantially adjacent the braiding point.

6. The braider of claim 5, wherein the braiding position stabilizing guide comprises:

a first braiding position stabilizing guide member, and a second braiding position stabilizing guide member, the first and second braiding position stabilizing guide members being disposed in a predetermined spaced relationship relative to the braiding point.

7. The braider of claim 1, comprising a dust collecting apparatus having a fan for sucking dust and a filter for catching dust.

8. The braider of claim 1, comprising a cutting apparatus for separating a completed braid formed by the braider from yarns connected to the completed braid.

* * * * *